US008840352B2

(12) United States Patent
Taggart et al.

(10) Patent No.: US 8,840,352 B2
(45) Date of Patent: Sep. 23, 2014

(54) APPARATUS AND METHOD FOR HANDLING PIPE

(75) Inventors: Mark Charles Taggart, City of High River (CA); Kevin John Scott Kerr, City of High River (CA)

(73) Assignee: Rangeland Industrial Services Ltd, Highriver, Alberta (CA)

( * ) Notice: Subject to any disclaimer, the term of this patent is extended or adjusted under 35 U.S.C. 154(b) by 38 days.

(21) Appl. No.: 13/220,185

(22) Filed: Aug. 29, 2011

(65) Prior Publication Data

US 2012/0121364 A1 May 17, 2012

(30) Foreign Application Priority Data

Nov. 12, 2010 (CA) ..... 2720802

(51) Int. Cl.
*E21B 19/00* (2006.01)
*B66F 11/00* (2006.01)
*E21B 19/15* (2006.01)

(52) U.S. Cl.
CPC ..... *E21B 19/155* (2013.01)
USPC ..... 414/22.58; 414/22.54; 414/22.57; 414/745.9; 414/745.1

(58) Field of Classification Search
USPC ..... 414/22.51–22.71, 745.1, 745.4–745.6, 414/745.9, 746.1–746.2, 746.4, 910, 911
See application file for complete search history.

(56) References Cited

U.S. PATENT DOCUMENTS

| | | | | |
|---|---|---|---|---|
| 7,404,697 | B2 * | 7/2008 | Thompson | 414/22.58 |
| 8,033,779 | B2 * | 10/2011 | Gerber et al. | 414/745.9 |
| 8,052,368 | B2 * | 11/2011 | Littlewood et al. | 414/22.52 |
| 2006/0285941 | A1 * | 12/2006 | Fikowski et al. | 414/22.54 |
| 2009/0053013 | A1 * | 2/2009 | Maltby | 414/22.61 |
| 2009/0196711 | A1 * | 8/2009 | Gerber et al. | 414/22.58 |
| 2011/0070054 | A1 * | 3/2011 | Crossley et al. | 414/22.61 |
| 2011/0072596 | A1 * | 3/2011 | Kenny | 14/69.5 |
| 2012/0130537 | A1 * | 5/2012 | Gerber | 700/244 |

* cited by examiner

*Primary Examiner* — Saul Rodriguez
*Assistant Examiner* — Lynn Schwenning
(74) *Attorney, Agent, or Firm* — Olympic Patent Works, PLLC

(57) ABSTRACT

A pipe handling catwalk is provided for moving tubulars or pipe to and from a work floor of well drilling or service rigs. The catwalk includes a variable height V-door for guiding pipe to the work floor. The V-door is made of a series of sequential pivotally attached segments that can extend from, and retract into, the catwalk at an angle relative to the catwalk along a guide track disposed at an end of the catwalk.

22 Claims, 29 Drawing Sheets

APPARATUS AND METHOD FOR HANDLING PIPE

CROSS-REFERENCE TO RELATED APPLICATION

This application claims priority from Canadian Application No. 2,720,802, filed Nov. 12, 2010.

TECHNICAL FIELD

The present disclosure is related to the field of pipe handling equipment for use in both the drilling and servicing of wells, in particular, automated pipe handling catwalks capable of varying the height of a V-door that can be extended from, and retracted into, the catwalk.

BACKGROUND

There is a short fall in all current automated pipe handling equipment for the well service industry. There is a need to vary the height of a V-door on well service rig automated pipe handling systems, and other automated pipe handling applications were variable V-door height is required. Specifically, when performing well servicing, different wells, locations, or service processes require different blow-out preventer ("BOP") systems, wellhead configurations, or other well control requirements causing the work floor on the service rig to be positioned at varying heights. The work floor height of a service rig must change to accommodate these different applications, and also requires the V-door height to change accordingly. Existing designs use a telescoping tube in tube designs, or fixed designs that are prone to have pipe size and weight restrictions, as well as transition problems were these tubes meet. These designs also require that the V-door be fixed in position at rig-up, or pivot/fold into position, and further require a crane to perform these functions. There is also a need for a positive drive skate system to move tubulars to and from the drilling rig work floor, and to provide the ability to "grab" the tubulars and pull them along the horizontal direction of the catwalk to enable kicking, indexing or positioning of these tubular. This is especially so when pulling tubulars without conventional upsets or thread protectors, ie, "slick pipe", along the surface of the catwalk deck to position the tubulars for kicking, indexing or delivery. Existing grabbers do not clamp the pipe between the skate v-plate with sufficient force to overcome the friction required to pull the pipe rearward.

It is, therefore, desirable, to provide an automated pipe-handling catwalk that addresses the shortcomings in current pipe-handle equipment, as noted above.

SUMMARY

An apparatus and method for handling pipe is provided. In some embodiments, the apparatus can comprise a substantially horizontal catwalk with first and second ends where the first end can be placed near a drilling or service rig, and the second end placed away from the rig. The catwalk can further comprise a trough disposed on a top surface of the catwalk between the first and second ends.

In some embodiments, the catwalk can comprise a V-door that can be slidably disposed in the catwalk wherein the V-door can extend from, and retract into, the first end of the catwalk. The catwalk can further comprise a V-door guide track disposed on the first end that can guide the V-door into an angled position relative to the catwalk. To enable the V-door to move a substantially horizontal configuration when disposed in the catwalk to an angled configuration when extended from the catwalk, the V-door can comprise a plurality of V-door segments sequentially and pivotally attached to each other wherein adjacent segments can pivot relative to one another when the V-door is extended from the catwalk up the V-door guide track to a desired height relative to the work floor of the drilling or service rig.

In some embodiments, the apparatus can further comprise a skate configured to move back and forth along the trough between the second and first ends. The skate can comprise a push plate to move or push pipe placed in the trough towards the first end of the catwalk and up the V-door to be presented to the work floor of the drilling or service rig. In some embodiments, the skate can comprise a grabber head mechanism configured for automatically clamping and holding a pipe retrieved from the work floor, and for pulling the pipe down the V-door and along the trough towards the second end of the catwalk.

Broadly stated, in some embodiments, a pipe handling apparatus is provided, comprising: a substantially horizontal catwalk further comprising first and second ends and a top surface disposed therebetween, the catwalk further comprising a horizontal guide track disposed within the catwalk extending from the first end at least partially towards the second end; a pipe trough disposed on the top surface between the first and second ends; a V-door comprising a plurality of trough segments, the V-door slidably disposed in the catwalk, the V-door further configured to move along the horizontal guide track to extend from, and retract into, the first end of the catwalk; a V-door guide track disposed at the first end of the catwalk and aligned with the horizontal guide track, the V-door guide configured to guide the V-door from a substantially horizontal position when disposed in the catwalk to an angled position relative to the catwalk when the V-door is extended from the catwalk along the horizontal guide track, the plurality of trough segments pivotally attached to each other to form a sequential series of segments wherein adjacent trough segments can pivot relative to one another when the V-door is guided through the V-door guide track; and a V-door drive mechanism disposed in the catwalk, the V-door drive mechanism configured to move the V-door along the horizontal and V-door guide tracks.

Broadly stated, in some embodiments, a method for handling pipe is provided, the method comprising the steps of: providing a pipe handling apparatus, comprising: a substantially horizontal catwalk further comprising first and second ends and a top surface disposed therebetween, the catwalk further comprising a horizontal guide track disposed within the catwalk extending from the first end at least partially towards the second end, a pipe trough disposed on the top surface between the first and second ends, a V-door comprising a plurality of trough segments, the V-door slidably disposed in the catwalk, the V-door further configured to move along the horizontal guide track to extend from, and retract into, the first end of the catwalk, a V-door guide track disposed at the first end of the catwalk and aligned with the horizontal guide track, the V-door guide configured to guide the V-door from a substantially horizontal position when disposed in the catwalk to an angled position relative to the catwalk when the V-door is extended from the catwalk along the horizontal guide track, the plurality of trough segments pivotally attached to each other to form a sequential series of segments wherein adjacent trough segments can pivot relative to one another when the V-door is guided through the V-door guide track, and a V-door drive mechanism disposed in the catwalk, the V-door drive mechanism configured to move the V-door along the horizontal and V-door guide tracks; extending the V-door from the catwalk and up the V-door guide track to a desired height wherein the V-door is adjacent to a work floor of a well drilling or service rig; placing a section of pipe in the trough; and moving the section of pipe along the trough towards the first end and up the V-door wherein the section of pipe is presented to the work floor.

DETAILED DESCRIPTION OF EMBODIMENTS

Figure 1:
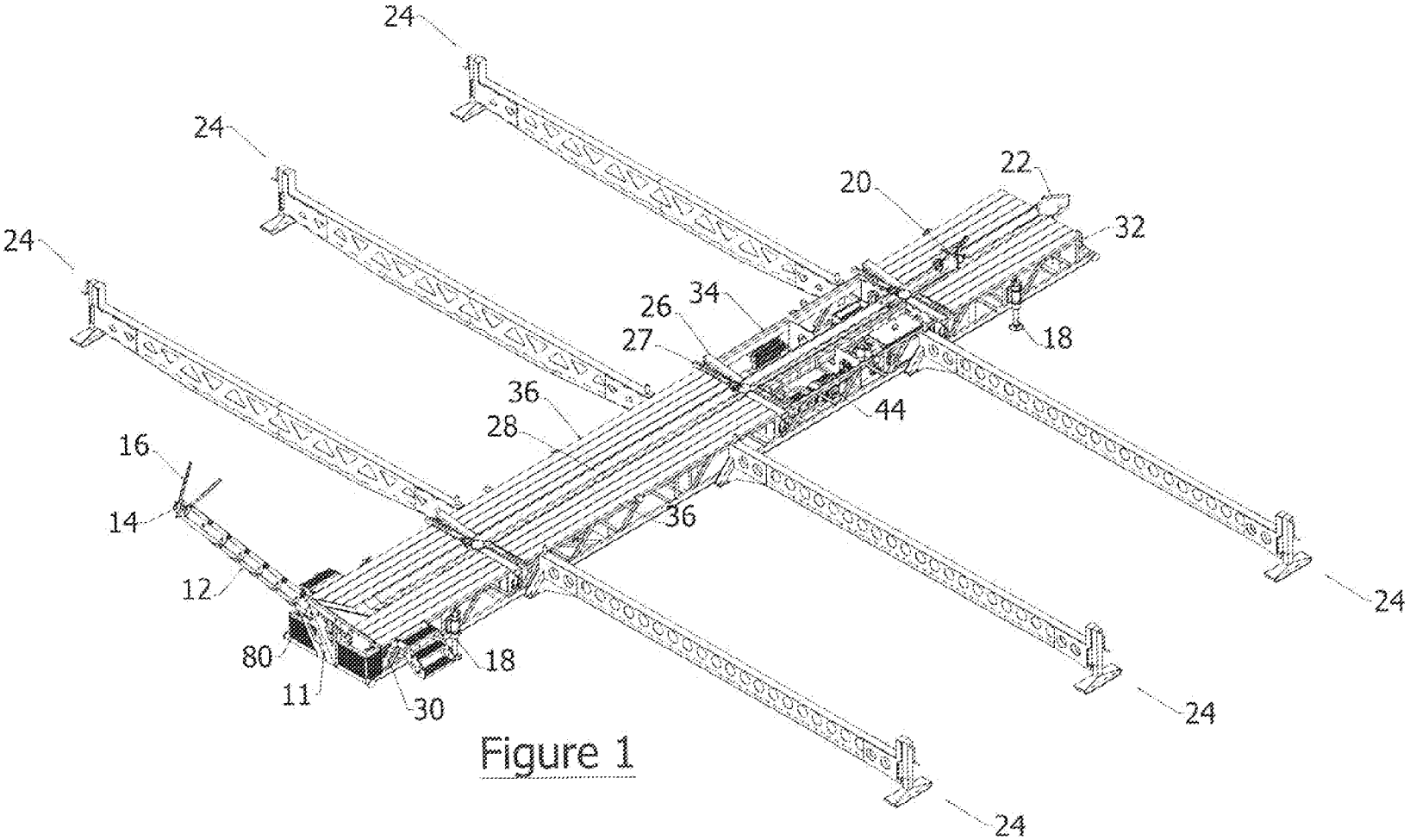
FIG. 1 is a perspective view depicting one embodiment of an automated pipe handling catwalk having a variable height V-door, and pipe racks attached thereto.

Referring to FIGS. 1 to 7, an apparatus for handling pipe is shown. In some embodiments, catwalk 10 can comprise substantially horizontal base assembly 11 that can comprise a lattice frame structure with top surface or deck 36. Base assembly 11 can be configured in dimension for transport on a flatbed trailer, and for skidding into position near a well drilling or servicing rig. Catwalk 10 can further comprise trough 28 disposed along the length of catwalk 10 for receiving pipe. Base assembly 11 can further comprise one or more levelling legs 18 disposed in a spaced-apart configuration around the perimeter of base assembly 11 that can individually raise or lower catwalk relative to the ground to bring deck 36 to a level position, or to align with pipe racks 24. Legs 18 can be hydraulically operated, electrically operated or manually operated to raise or lower catwalk 10.

In some embodiments, the length of catwalk 10 and, therefore, deck 36 can be set to accommodate range 2 pipe (up to 36 ft. pipe). In other embodiments, the length can be set to accommodate range 3 pipe (up to 49 ft. pipe). In these embodiments, catwalk 10 can comprise skate stop 22 disposed thereon extending from the second end thereof. Skate 20 can be further configured to extend into skate stop 22 to provide sufficient room on deck 36 to accommodate range 3 pipe. In some embodiments, catwalk 10 can comprise one or more stair assemblies 40 to allow personnel access to pipe deck 36 and V-door 12.

In some embodiments, catwalk 10 can further comprise a plurality of pipe racks 24 extending from base assembly 11 on one or both of the driller's side and off driller's side of catwalk 10, or independently supported by the ground, for storing pipe in single or multiple levels on pipe racks 24. Catwalk 10 can further comprise a plurality of indexers 26 and kickers 27 disposed along trough 28 in a spaced-apart configuration for loading pipe from pipe racks 24 into trough 28, or for ejecting pipe from trough 28 for storage on pipe racks 24. In some embodiments, pipe racks 24 can further comprise adjustable legs to provide sufficient tilt to urge pipe to roll towards trough 28, or away from trough 28 depending on which pipe rack 24 is being used for pipe that is to be tripped in, and which pipe rack 24 is being used to store pipe being tripped out.

In some embodiments, catwalk 10 can comprise, on a first end thereof, V-door 12 slidably disposed in catwalk 10 wherein V-door 12 can extend from catwalk 10 along horizontal guide track 81 through V-door guide track 80 at an angle relative to the ground and catwalk 10. To accomplish this, V-door 12 can comprise of a number of individual V-door sections or segments 52 or 50 that can be pinned together to form one continuous V-door. The pin or pivot placement between V-door segments 50 can be selected to allow one segment 50 to rotate upward relative to an adjacent segment 50. This can allow V-door 12 to "bend" from a horizontal position under deck 36 of catwalk 10 (transport or storage), to an inclined position (operation) as V-door 12 is extended from catwalk 10 through V-door guide track 80. In some embodiments, each segment 50 can comprise a leading edge 49 and a trailing edge 47 (see FIG. 6). As segments 50 are "bending" relative to one another, leading and trailing edges 49 and 47 of adjacent segments 50 can separate or pull away from one another as segments 50 are pivoting about pivot attachment 82. As segments 50 are extended upwards through V-door guide track 80, leading and trailing edges 49 and 47 of adjacent segments 50 can contact each other thereby "locking" the segments together as gravity pulls segments 50 downwards as they exit V-door guide track 80.

Figure 4:
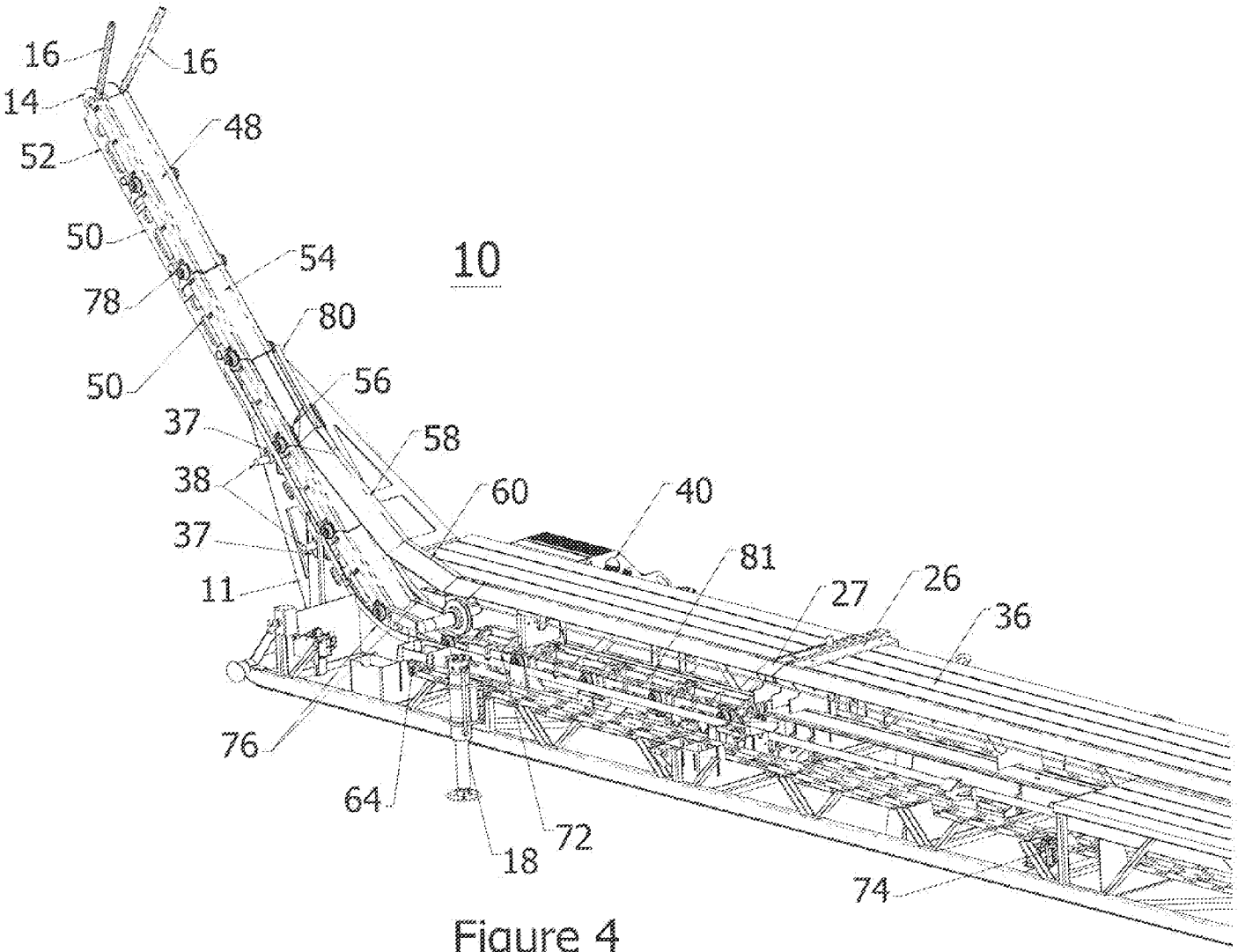
FIG. 4 is a close-up perspective view depicting the catwalk of FIG. 1.
Figure 5:
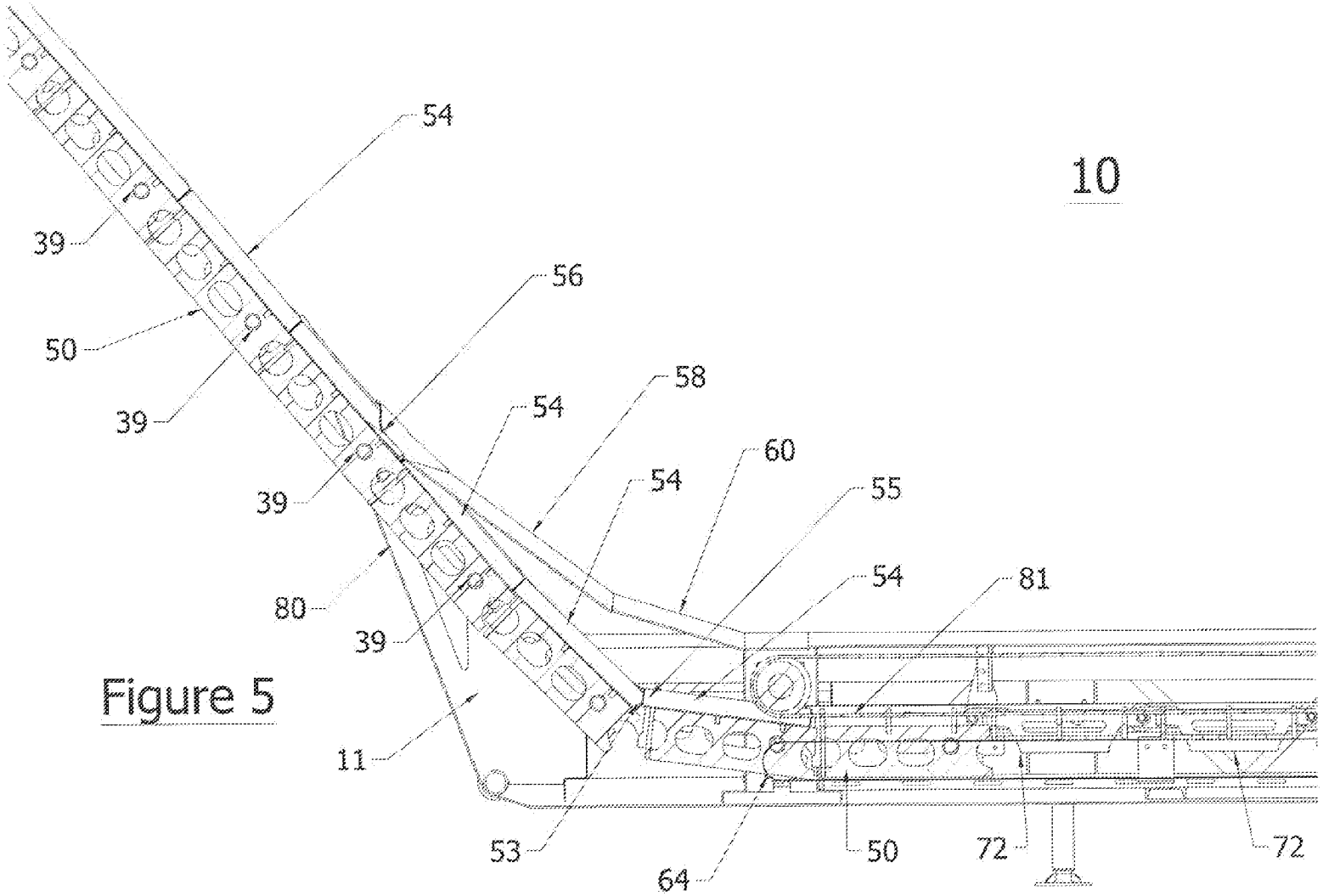
FIG. 5 is a close-up side elevation view depicting the catwalk of FIG. 4.
Figure 6:
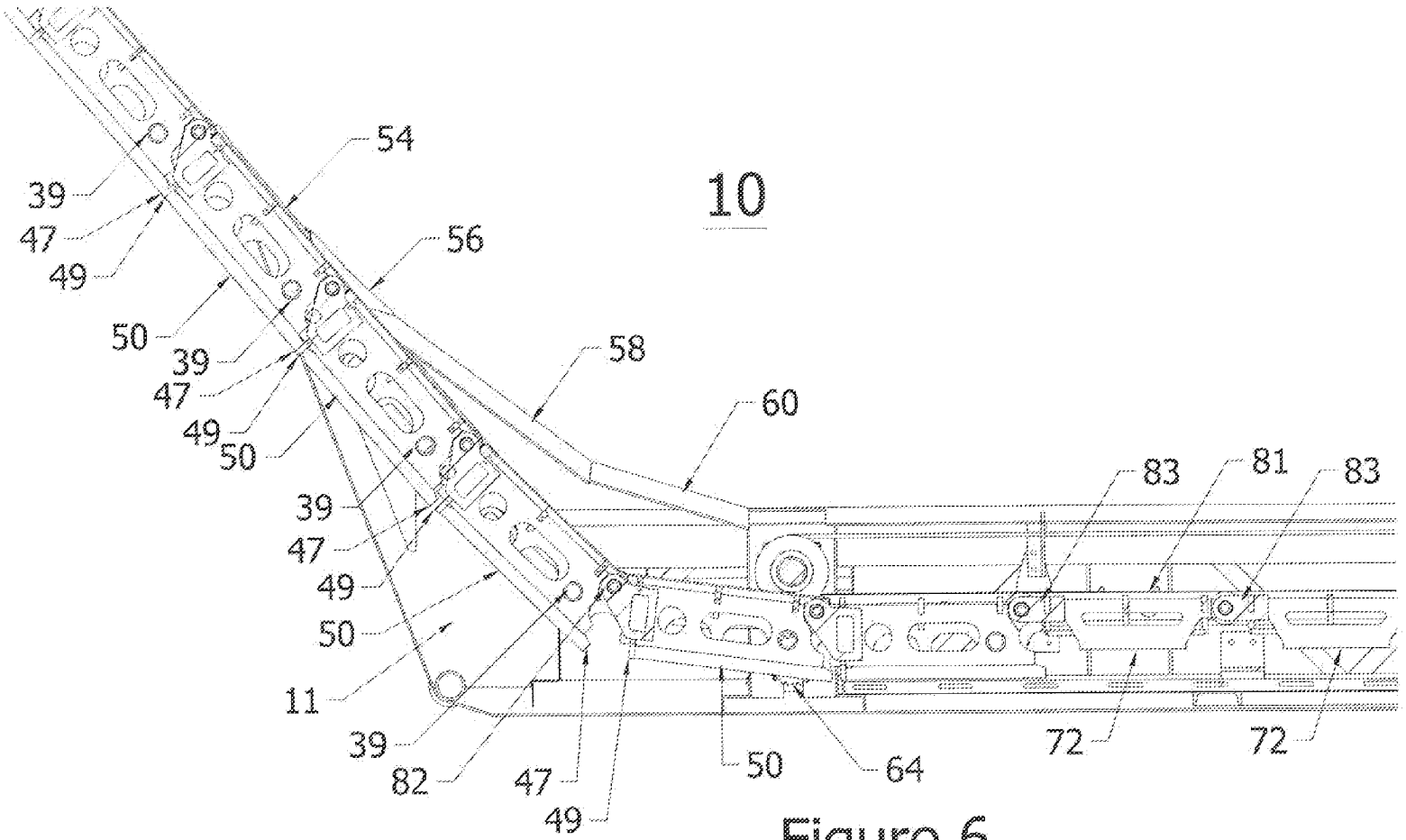
FIG. 6 is a close-up side elevation view depicting the catwalk of FIG. 5.
Figure 7:
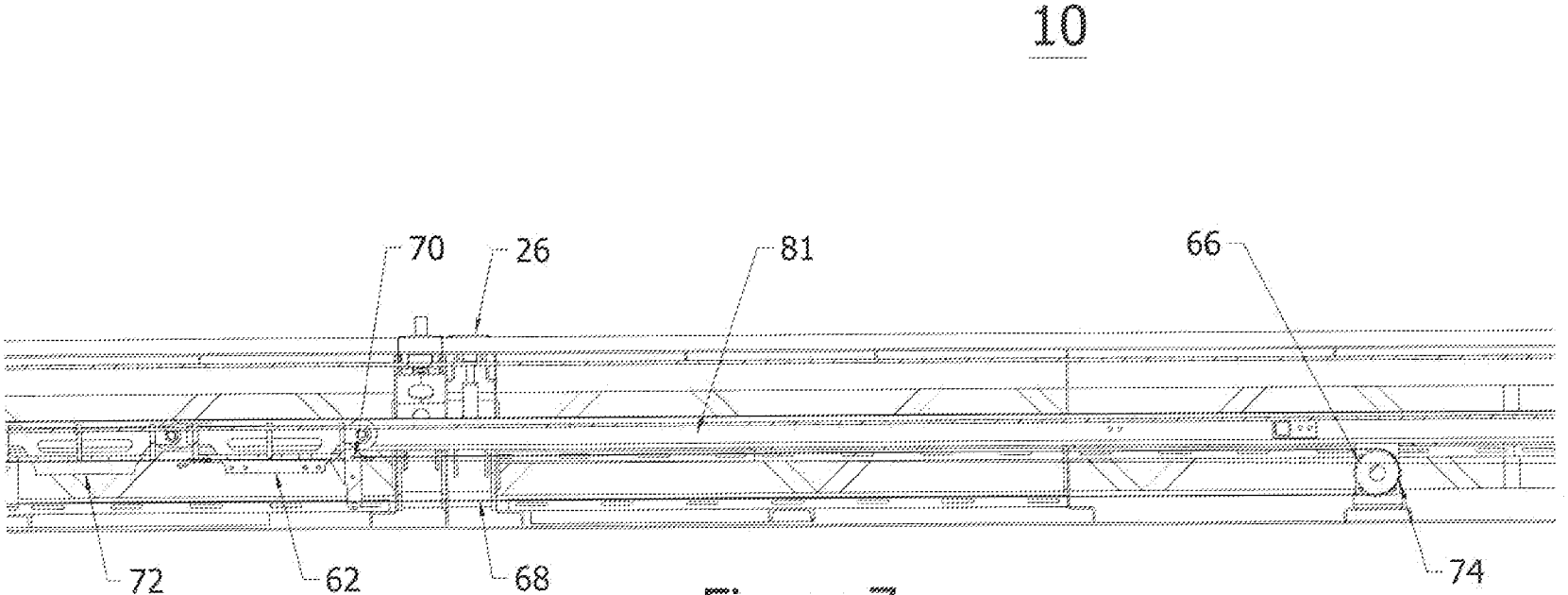
FIG. 7 is a side elevation view depicting the V-door drive mechanism of the catwalk of FIG. 3.
Figure 8:
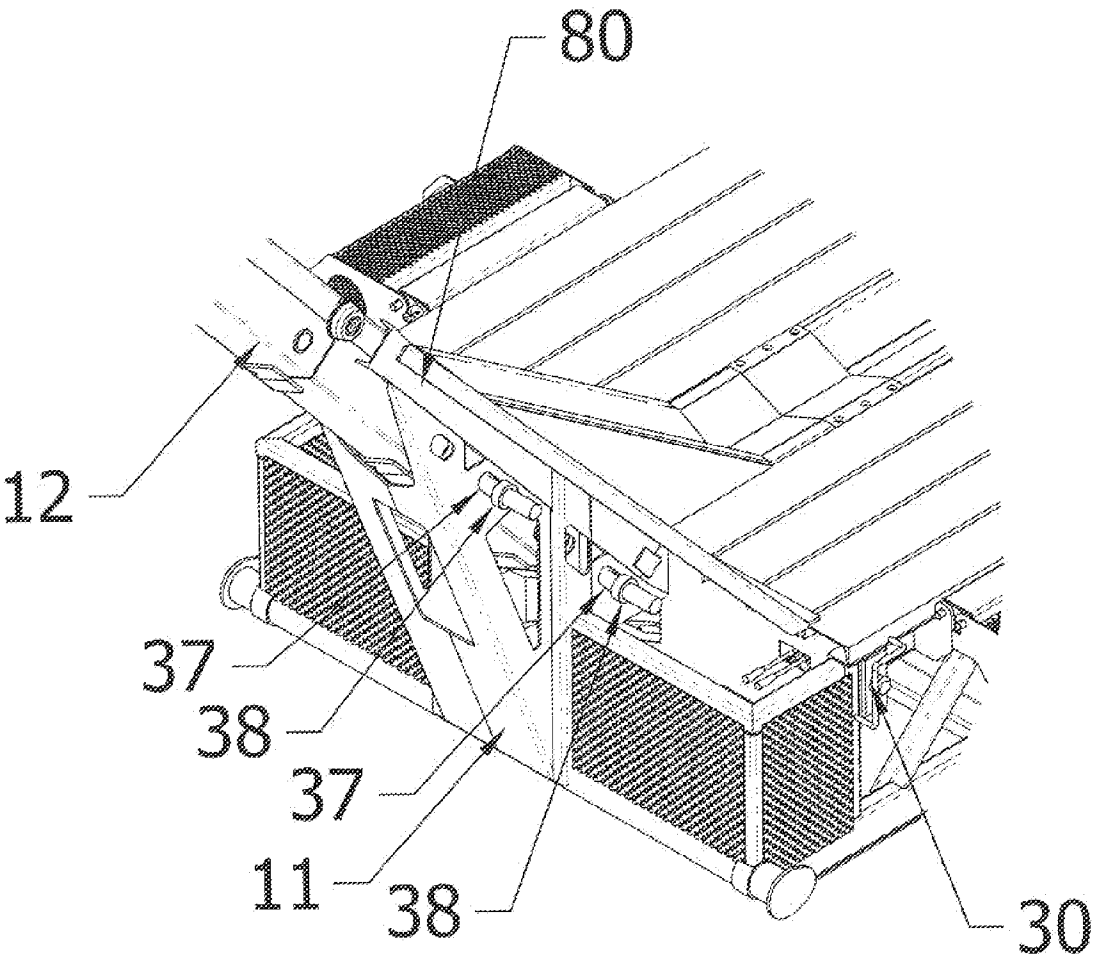
FIG. 8 is a perspective view depicting the V-door and base assembly of the catwalk of FIG. 1.

To accommodate changing work floor heights of the well drilling or service rig, the height of V-door 12 can be adjusted in 6 inch vertical increments from 4 ft to 17 ft by inserting lock pins 38 through any one of a plurality of openings 37 disposed on base assembly 11 and into pin receiving sleeves 39 disposed in segments 50 (as shown in FIGS. 4 and 8). It is obvious to those skilled in the art that the maximum height of V-door 12 is only limited by the number of individual V-door segments 50 and the number and position of openings 37 disposed on base assembly 11. When the height of V-door 12 has been set with pins 38 inserted through openings 37 into receiving sleeves 39, any remaining segments 50 are positioned under deck 36 in horizontal guide track 81. V-door 12 can then be retracted to lock pins 38 in place. To change the height of V-door 12, V-door 12 can be extended so as to unlock pins 38 and remove them, and then moving V-door 12 to the desired height, followed by locking V-door 12 into position with pins 38, as described above.

In some embodiments, V-door 12 can comprise an upper or first segment 52, which is the outer most segment of V-door 12. Upper segment 52 can further comprise pipe roller 14 rotatably disposed on the upper end of upper segment 52. Upper segment 52 can also comprise pipe bars 16 extending from the upper end of segment 52. Roller 14 can aid in the movement of pipe along V-door 12. Pipe bars 16 can aid as guides in receiving pipe from a work floor to V-door 12. Upper segment 52 can be pivotally attached to an adjacent V-door segment 50 that, in turn, can be pivotally attached to a sequential series of similarly pivotally attached V-door segments 50. V-door 12 can further comprise one or more "push" segments 72 that can also be pivotally attached to one another, and to the lower most V-door segment 50. The rear most push segment 62 can further comprise drive chain attachments 70 configured to couple to drive chain 68.

Figure 3:
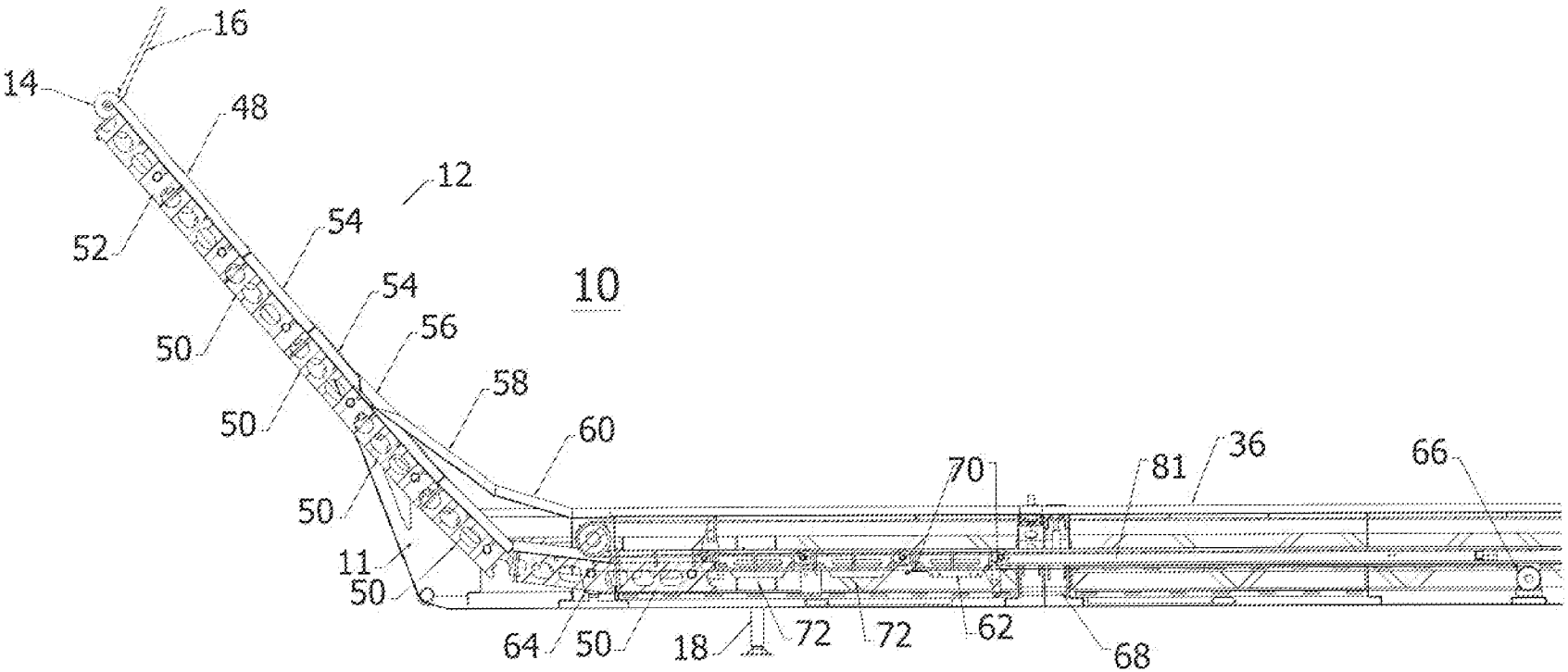
FIG. 3 is a side elevation view depicting the catwalk of FIG. 1.

In some embodiments, the actuation system for V-door 12 can comprise of a push/pull carriage drive using chain 68 or any suitable functional equivalent, which can include but is not limited to a cable, a rack and pinion system, hydraulically or pneumatically operated cylinders or rods, or any other drive mechanism as well known to those skilled in the art. In some embodiments, chain 68 can be driven by chain drive motor 74 coupled to drive sprocket 66, where drive motor 74 can be disposed within base assembly 11 under deck 36 at or away from the first end of catwalk 10. Chain 68 can further extend through base assembly 11 towards the first end of catwalk 10 and couple to front idler sprocket 64. It is obvious to those skilled in the art that, in other embodiments, the actuation system for V-door 12 can be arranged in any other functionally equivalent configuration. Referring to FIG. 3, when drive sprocket 66 is rotated counter-clockwise (as shown in FIG. 3), chain 68 can pull rear segment 62 towards the first end of catwalk 10 along horizontal guide track 81 wherein V-door 12 can extend from catwalk 10 and up V-door guide track 80 to an inclined position. When drive sprocket 66 is rotated clockwise, chain 68 can pull rear segment 62 away from the first end of catwalk 10 along horizontal guide track 81 wherein V-door 12 can retract into catwalk 10 from V-door guide track 80 to a horizontal position in catwalk 10.

In some embodiments, V-door segments 50, 52, 62 and 72 can comprise rollers 78 disposed on segment pivot attachments 82 and 83 that can be configured to travel along and be guided by horizontal guide track 81, V-door 12 can move from a horizontal position in catwalk 10 to an inclined or angled position relative to the ground and catwalk 10. As V-door 12 can be comprised of a plurality of segments, the height of V-door 12, when in the inclined position, can be limited only by the number of locking pin openings 37 disposed on base assembly 11. It is also obvious to those skilled in the art that rollers 78 can be substituted with sliders configured to slide in guide tracks 80 and 81.

In some embodiments, catwalk 10 can comprise one or more transition plates that can enable a smoother transition for pipe when being moved from trough 28 to V-door 12. Referring to FIGS. 3 to 6, catwalk 10 can comprise transition plate 60, which can provide a first transition from trough 28 at a shallow angle relative to catwalk 10. Catwalk 10 can further comprise transition plate 58, which can provide a second transition from transition plate 60 at an angle steeper than that of transition plate 60. In further embodiments, catwalk 10 can comprise transition interface plate 56, which can provide a transition from second transition plate 58 to V-door 12 and can further accommodate pipe of varying diameters. In some embodiments, interface plate 56 can comprise symmetrically curved plates to accommodate the change of diameter of different sized pipe, and can further comprise a three-dimensional center wedge section for lifting pipe to aid in its transition from transition plate 58 to V-door 12.

In some embodiments, upper segment 52 and its adjacent segment 50 can comprise v-shaped or trough-shaped dual top plate 48 that can extend the length of upper segment 52 and its adjacent segment 50. In other embodiments, each segment 50 can further comprise a v-shaped or trough-shaped single top plate 54 that can further comprise leading edge 55 and trailing edge 53. In some embodiments, trailing edge 53 of one segment 50 can be configured to pass under leading edge 55 of an adjacent segment 50 when V-door 12 is moving between an inclined position and a horizontal position (see FIG. 5).

Figure 9:
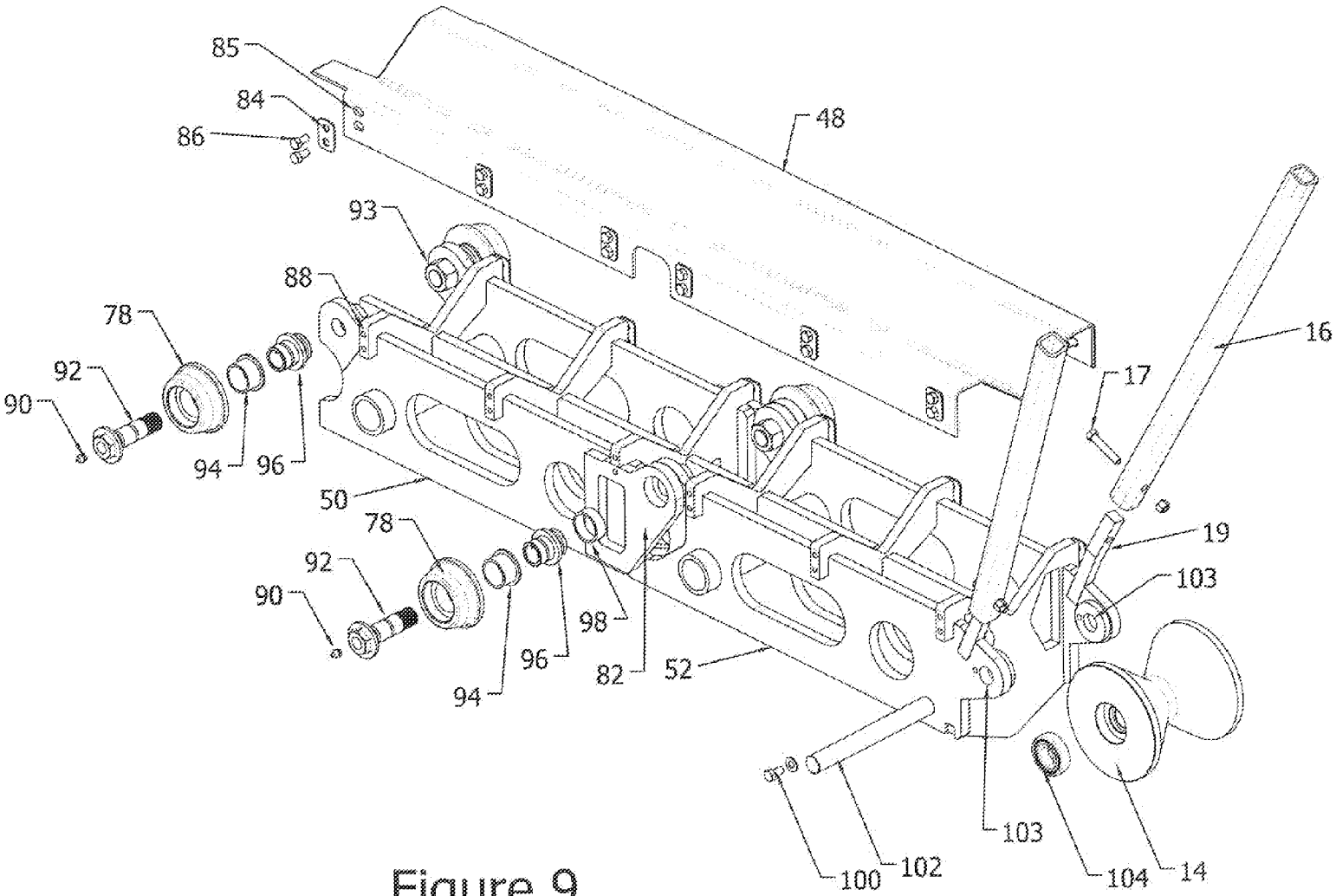
FIG. 9 is an exploded perspective view depicting the top two segments of the V-door of the catwalk of FIG. 3.
Figure 10:
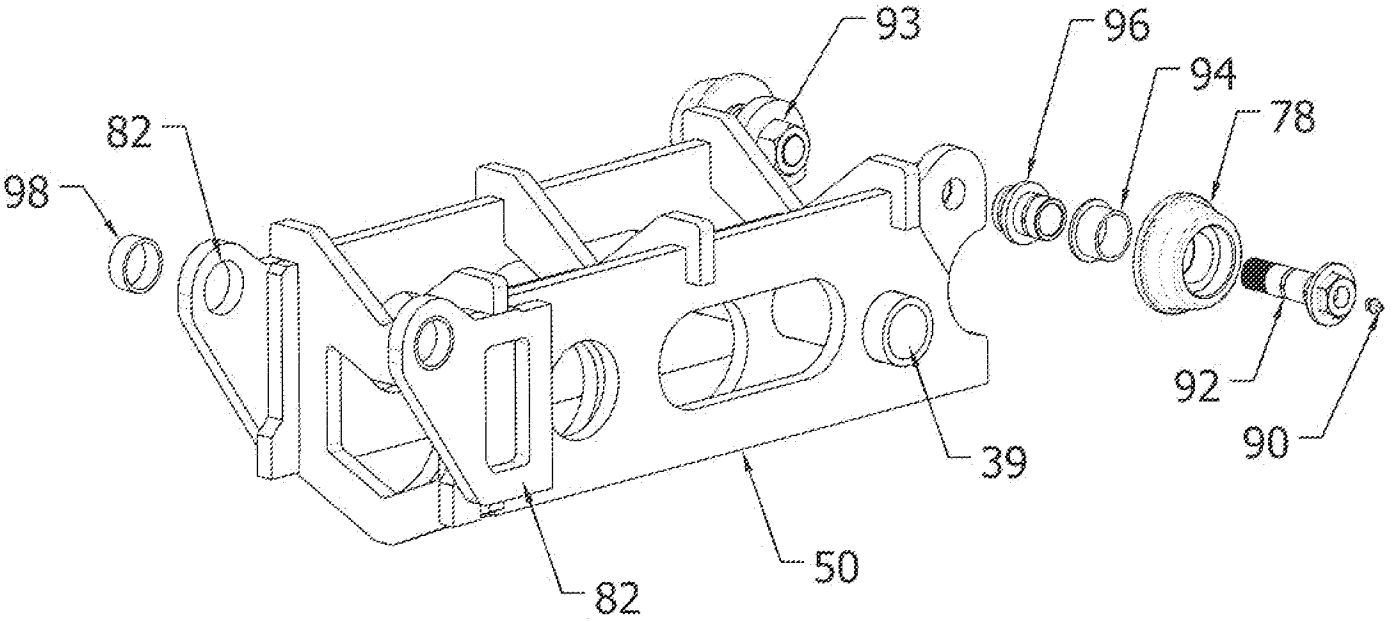
FIG. 10 is an exploded perspective view depicting a mid-section segment of the V-door of the catwalk of FIG. 3.

Referring to FIGS. 9 to 12, exploded views of some embodiments of segments 50, 52, 62 and 72 are shown. In FIG. 9, upper segment 52 and an adjacent segment 50 is shown. Each of segments 50 and 52 can comprise a lattice frame or box-like structure. In a representative embodiment, segments 50 and 52 can be comprised of steel plates welded together, or of a metal casting, to form the frame or structure configured to receive a V-shaped or trough-shaped top plate, as shown in FIGS. 9 and 10.

In some embodiments, segment 50 can comprise pivot attachment plate 82 to provide the means to pivotally attach to an adjacent segment 50 or 52, as shown in this FIG. 9. Pivot attachment plate 82 can be coupled to segment 52 by axle 92 passing through roller 78, axle bushing 94, axle spacer 96 and bushing 98 to pass through a corresponding opening disposed in segment 52 to threadably couple to axle nut 93. Each axle 92 can further comprise grease fitting 90 to allow grease to be injected therein to provide lubrication for roller 78. In some embodiments, this coupling mechanism can be deployed on both sides of the segments. In further embodiments, segment 52 can further comprise roller 14 rotatably disposed on axle 102 via bearings 104, wherein axle 102 passes through openings 113 and kept in position by axle keeping nut and washer 100 threaded into segment 52. Upper segment 52 can further comprise pipe bars 16 fastened to supports 19 disposed on upper segment 52 with nut and bolt 17. Dual top plate 48 can be attached to upper segment 52 and its adjacent segment 50 by bolts 86 passing through washers 84 and openings disposed in dual top plate 48 into threaded holes 88 disposed on upper segment 52.

Figure 11:
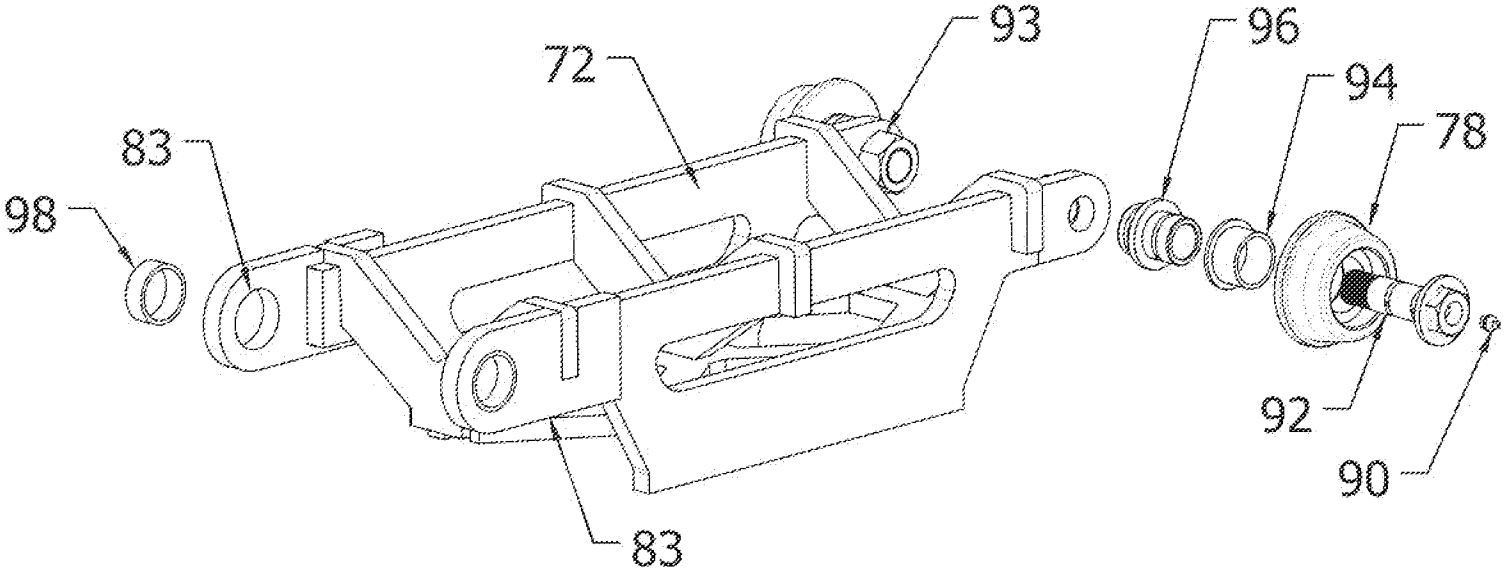
FIG. 11 is an exploded perspective view depicting a mid-section push segment of the V-door of the catwalk of FIG. 3.

Referring to FIG. 10, an exploded view of segment 50 is shown. In this view, locking pin receiving sleeve 39 can be seen. Referring to FIG. 11, an exploded view of push segment 72 is shown. In some embodiments, segment 72 is similar in configuration to segment 50 except that segments 72 do not comprise a top plate. Segments 72 can be pivotally attached to adjacent segments 72 or 50 via pivot attachment plate 83 and an axle and roller mechanism similar to that shown for segment 50 in FIGS. 9 and 10.

Figure 12:
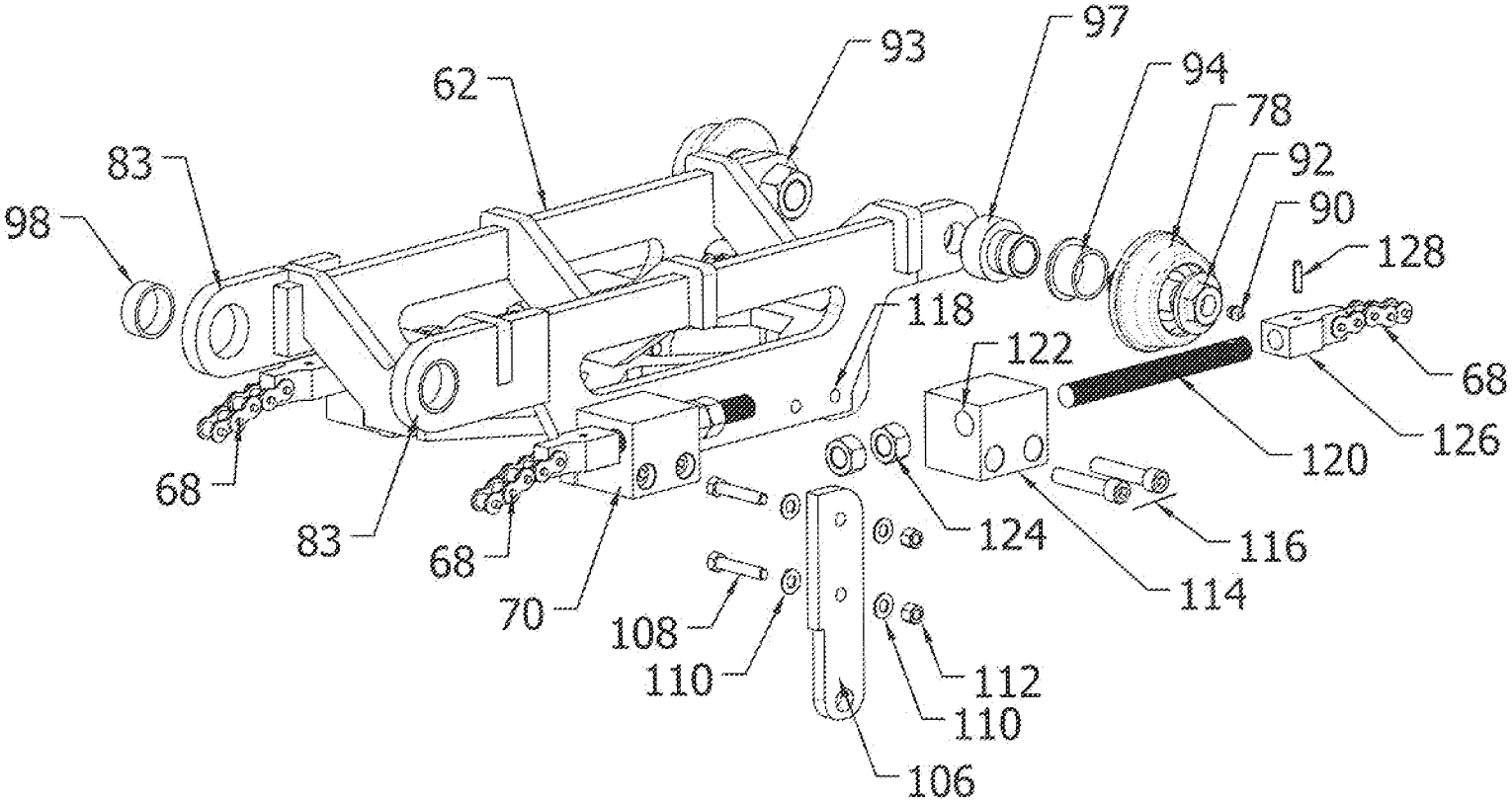
FIG. 12 is an exploded perspective view depicting the rear push segment of the V-door of the catwalk of FIG. 3.

Referring to FIG. 12, an exploded view of rear push segment 62 is shown. Similar to push segment 72, rear push segment 62 can further comprise drive chain attachment blocks 70 fastened to each end of segment 62 by bolts 116 passing through holes disposed in block 114 and threaded into holes 118. Chain 68 can be attached to blocks 70 by first being riveted to block 126 that can be threadably attached to threaded rod 120. Rod 120 can then pass through hole 122 disposed through block 114 and be threaded to locking nuts 124. In some embodiments, segment 62 can further comprise cable lug 106 fastened thereto with bolts 108, washers 110 and nuts 112. Cable lug 106 can be used with alternate drive mechanism, such as a cable or functional equivalent, to move segment 62 back and forth along horizontal guide track 81.

Figure 13:
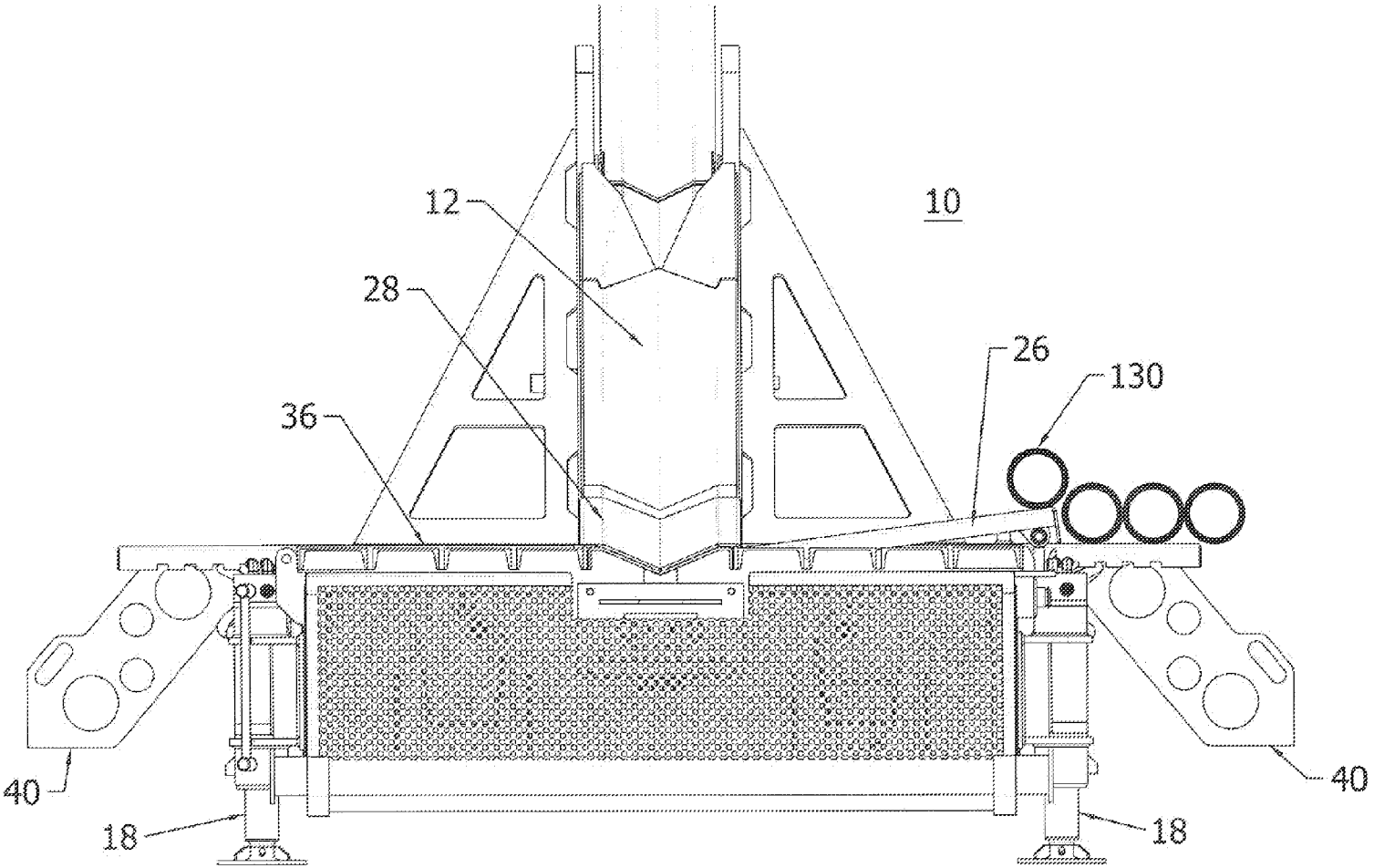
FIG. 13 is an end elevation view depicting a pipe being indexed into the trough of the catwalk of FIG. 1.
Figure 14:
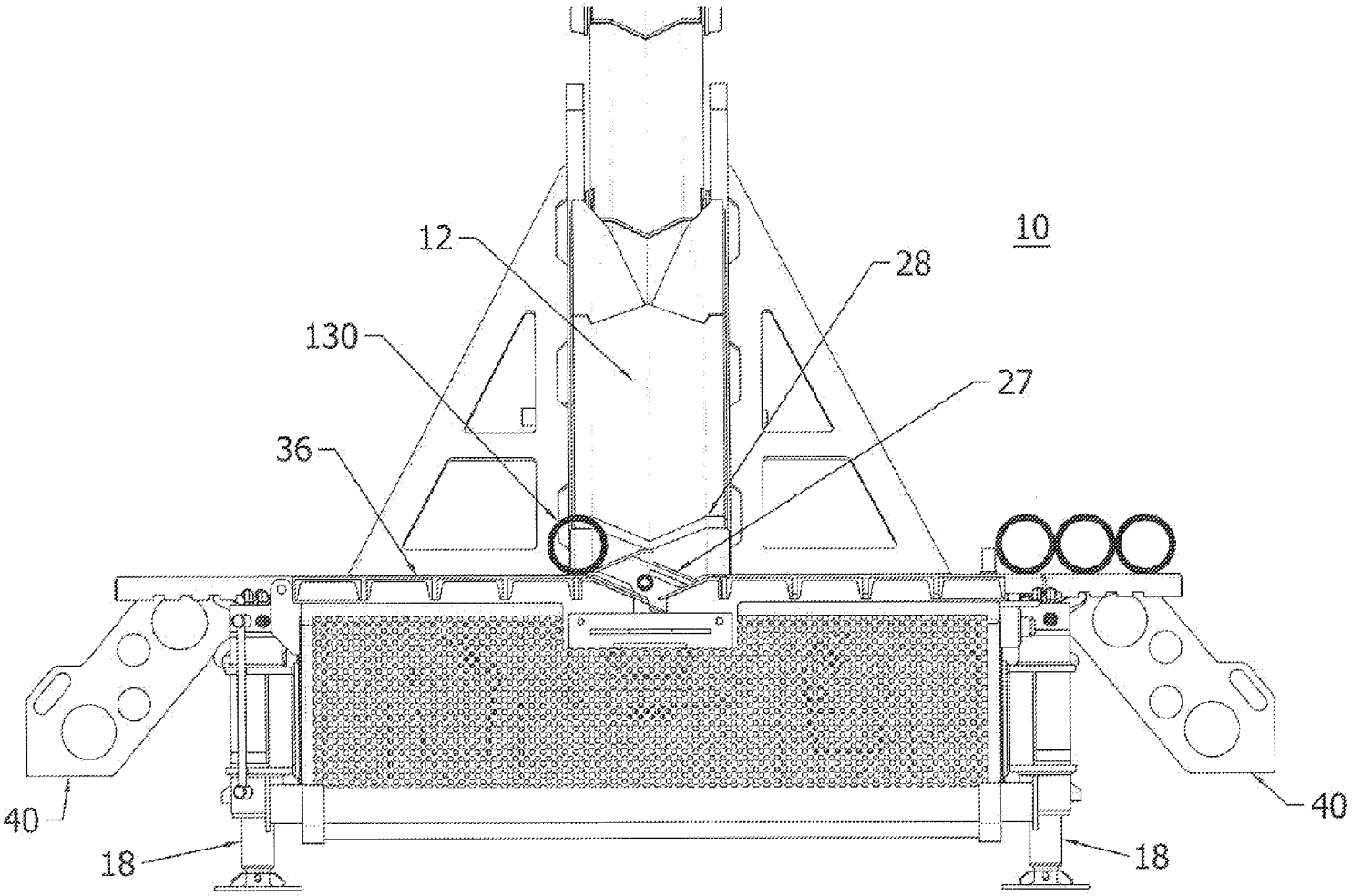
FIG. 14 is an end elevation view depicting a pipe being kicked out of the trough of the catwalk of FIG. 13.
Figure 15:
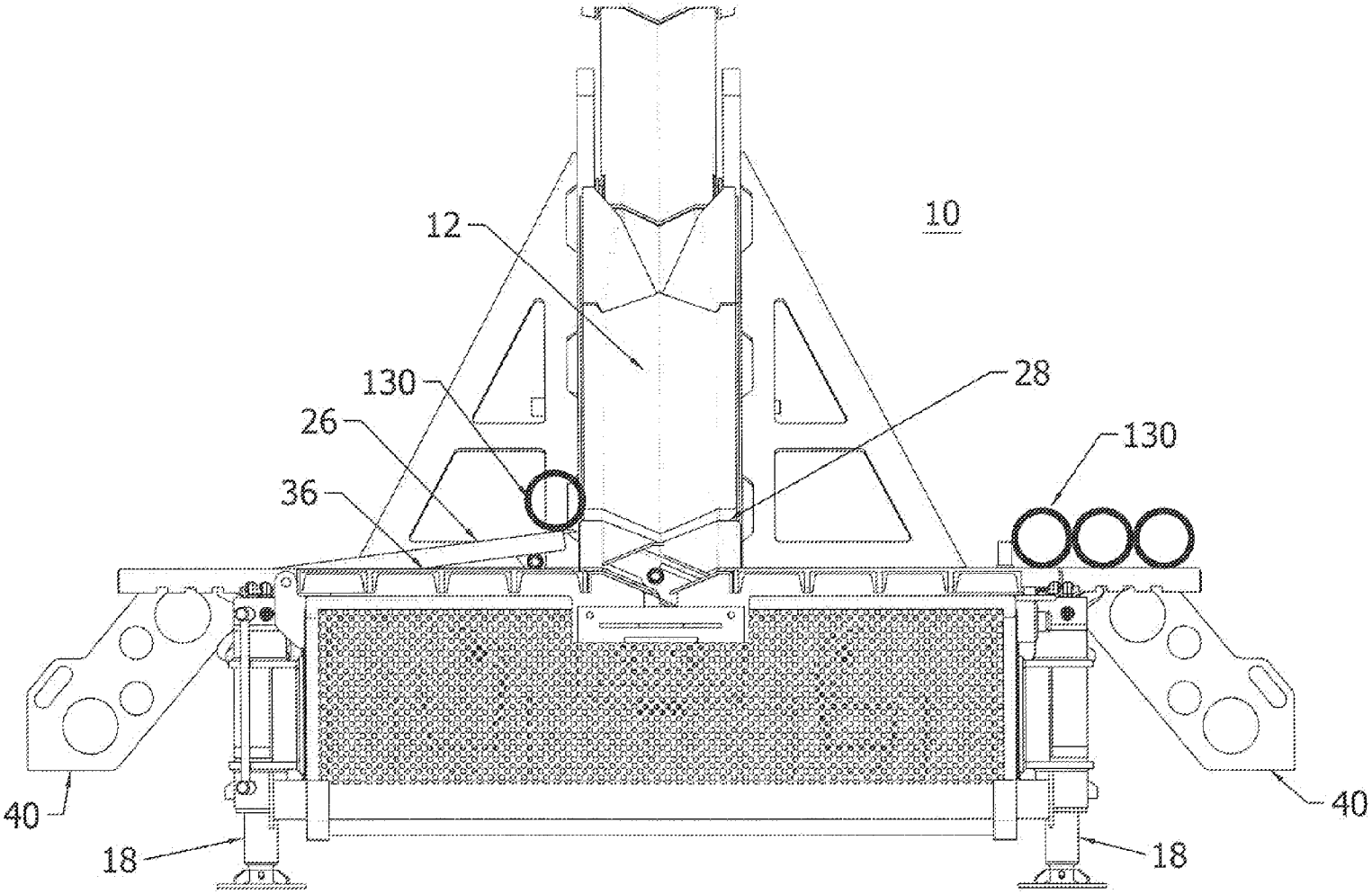
FIG. 15 is an end elevation view depicting a pipe being indexed away from the trough of the catwalk of FIG. 14.

Referring to FIGS. 13 to 15, catwalk 10 is shown moving pipe 130 in and out of trough 28. In FIG. 13, pipe 130 is being indexed into trough 28 via indexer 26 being tilted such that pipe 130 can roll downward into trough 28. In this position, pipe 130 can be moved along trough by skate 20 up V-door 12 to be presented to the work floor of a drilling or service rig. When pipe 130 is being retrieved from a rig, pipe 130 is brought down V-door 12 onto trough 28, as shown in FIG. 14. Kicker 27 can then be used to eject pipe 130 from trough 28 onto deck 36. Indexer 26 can then be tilted to roll pipe 130 away from trough 28, as shown in FIG. 15.

Figure 16:
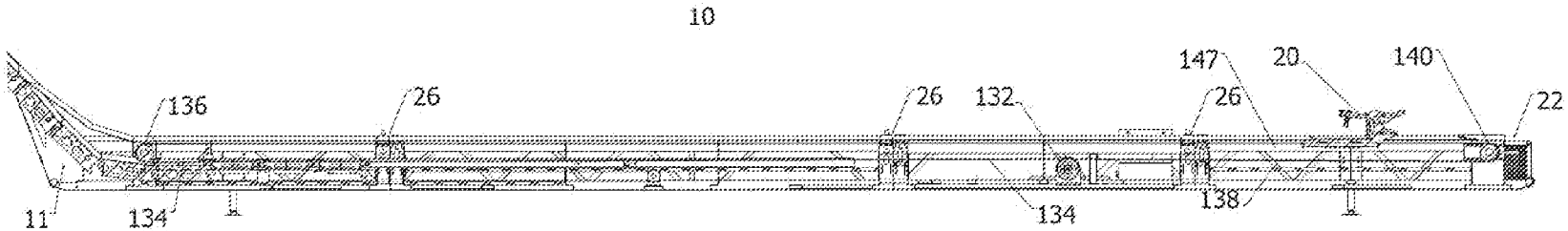
FIG. 16 is a side elevation view depicting the skate drive system of the catwalk of FIG. 1.

Referring to FIGS. 16 to 30, a skate for use with catwalk 10 is illustrated. In FIG. 16, a side view of skate 20 and its drive mechanism for some embodiments of catwalk 10 is shown. In some embodiments, skate 20 can move along skate guide track 147 disposed within catwalk 10 along trough 28. To move skate 20, catwalk 10 can comprise skate drive winch 132 disposed within catwalk 10. Winch 132 can further comprise front drive cable 134 that can extend from winch 132 towards front idler sheave 136 and back to couple to a front edge of skate 20. Winch 132 can further comprise rear drive cable 138 that can extend from winch 132 towards rear idler sheave 140 and back to couple to a rear edge of skate 20. Catwalk 10 can further comprise skate end stop 22 that can extend past the end of catwalk 10 when range 3 pipe are being handled (see FIG. 1 as well).

Figure 17:
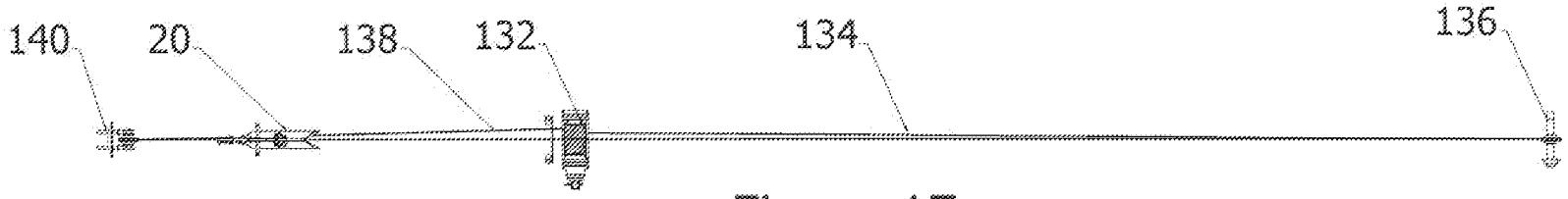
FIG. 17 is a top plan view depicting the skate drive system of FIG. 16.
Figure 18:
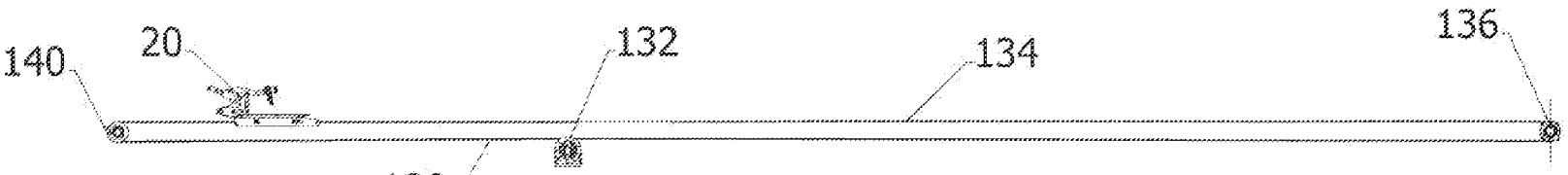
FIG. 18 is a side elevation view depicting the skate drive system of FIG. 17.
Figure 19:
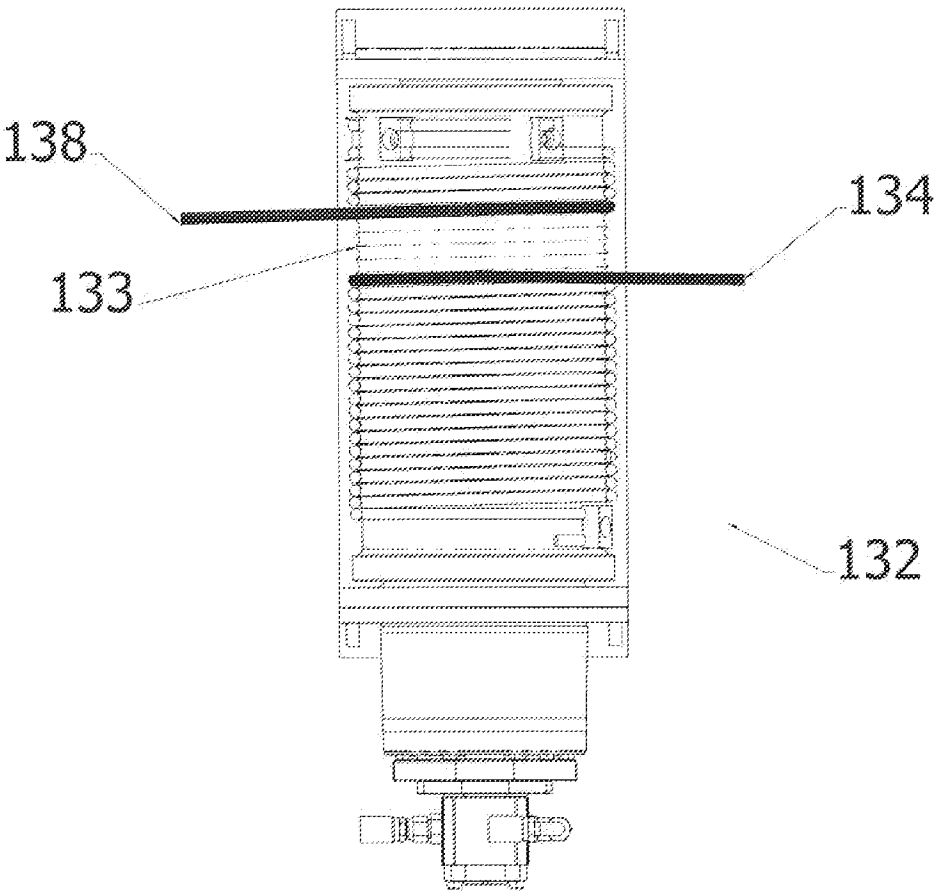
FIG. 19 is a top plan view depicting the skate drive winch of the skate drive system of FIG. 17.
Figure 20:
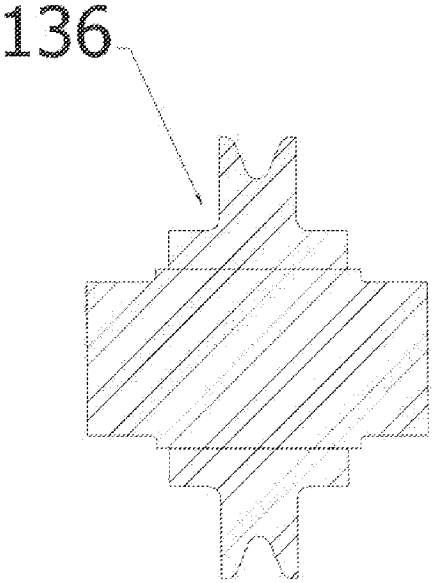
FIG. 20 is a cross-section view depicting the front idler sheave of the skate drive system of FIG. 18 along section lines A-A.

Referring to FIGS. 17 and 18, top and side views of the skate drive mechanism described above are shown. Referring to FIG. 19, winch 132 is shown, and can comprise helical grooved drum 133 that can be configured to couple to front and rear drive cables 134 and 138 simultaneously such that when drum 133 is rotating, cables 134 and 138 can be wound in and paid out, respectively, or vice versa depending on which direction drum 133 is rotating. As drum 133 rotates, skate 20 can move along skate guide track 147.

Referring to FIGS. 21 to 24, an embodiment of skate 20 is shown. In some embodiments, skate 20 can comprise trough 146, push plate 148, actuator bracket 143, cable actuator plate 142 slidably disposed in bracket 143 and a grabber head mechanism. Actuator plate 142 can further comprise slot 141 that can limit the degree of movement actuator plate 142 has in bracket 143 due to roller axles 139 that pass through slot 141 of bracket 143 to support rollers 145. Rollers 145 can be configured to travel along skate guide track 147. In other embodiments, rollers 145 can be substituted with slider blocks configured to travel along skate guide track 147. Actuator plate 142 can further comprise opening 149 for attaching to front cable 134 and opening 151 for attaching to rear cable 138.

In some embodiments, the grabber head mechanism can comprise grabber arm 156 pivotally attached to linkage plate 160 and to locking plate 150 that is, in turn, pivotally attached to slider plate 164. Grabber arm 156 can further comprise counter weight 158 to offset the weight of grabber head 144. Slider plate 168 can comprise slot 165 that can allow it to move within linkage plate 160, the movement limited by bolts 168 passing through linkage plate 160 and slot 165. Slider plate 168 can further be connected to actuator plate 142 via actuating rod 162.

Figure 21:
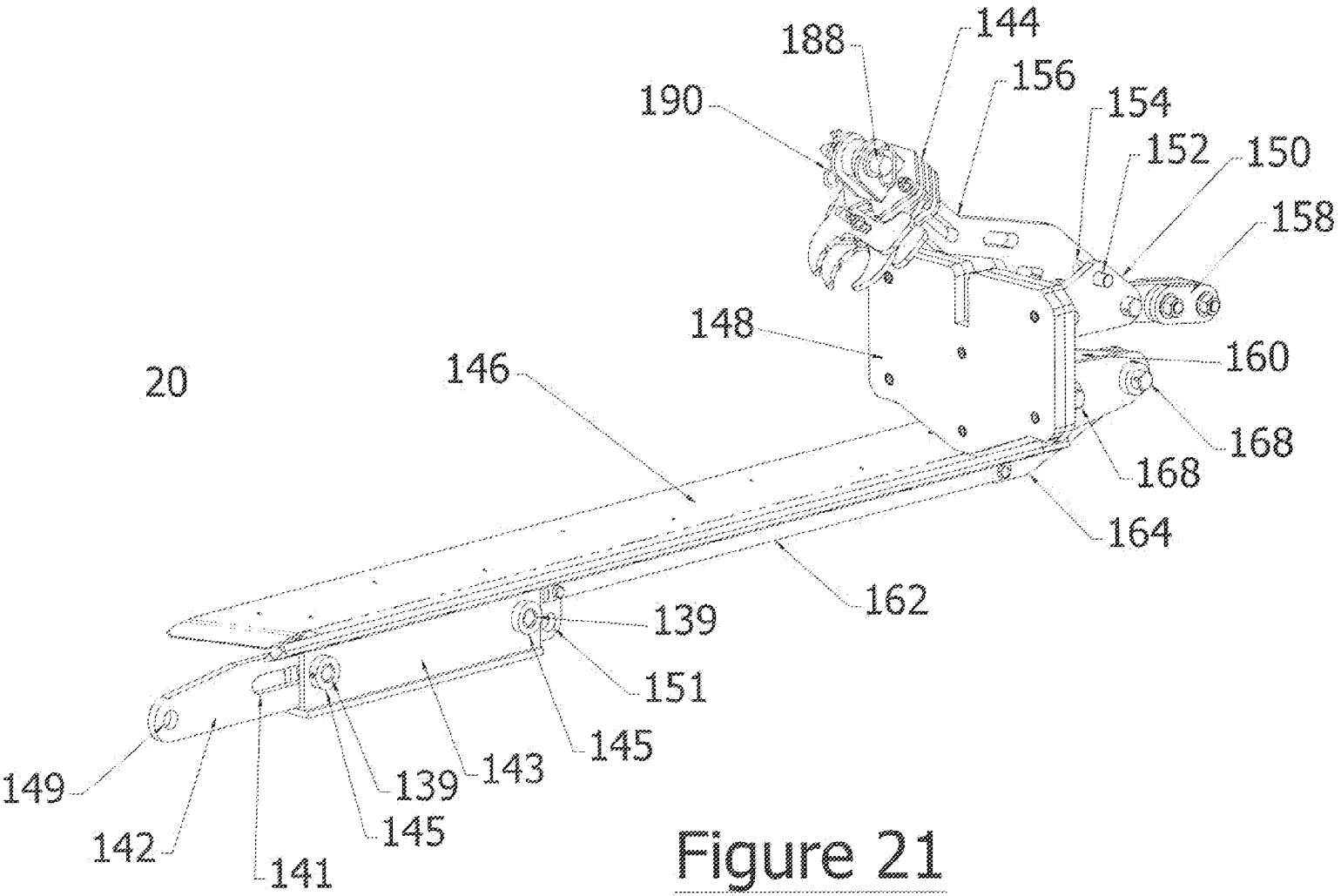
FIG. 21 is a close-up perspective view depicting the skate of the catwalk of FIG. 1, with the grabber head in a raised position.
Figure 23:
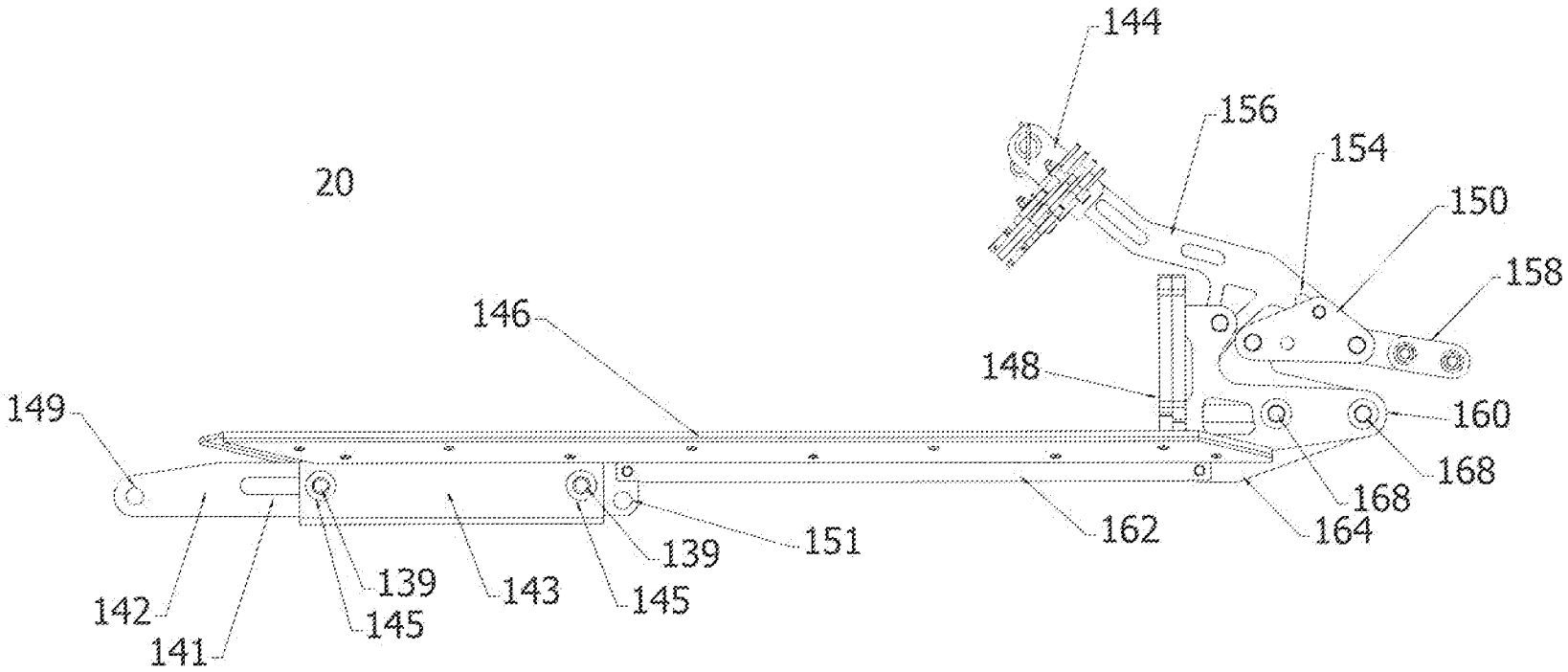
FIG. 23 is a side elevation view depicting the skate of FIG. 21.

When winch 132 is operated to move skate 20 to push a pipe in trough 28 up V-door 12, front cable 134 draws actuator plate 142 forward relative to skate 20. This action draws actuator rod 162 forward as well drawing slider plate 164 forward as well. Due to the geometrical relationship between slider plate 164, locking plate 150, grabber arm 156 and linkage plate 160, the action of actuator plate 142 being pulled forward by front cable 134 causes grabber arm 156 to rotate and lift grabber head 144 away from trough 146, as shown in FIGS. 21 and 23.

Figure 22:
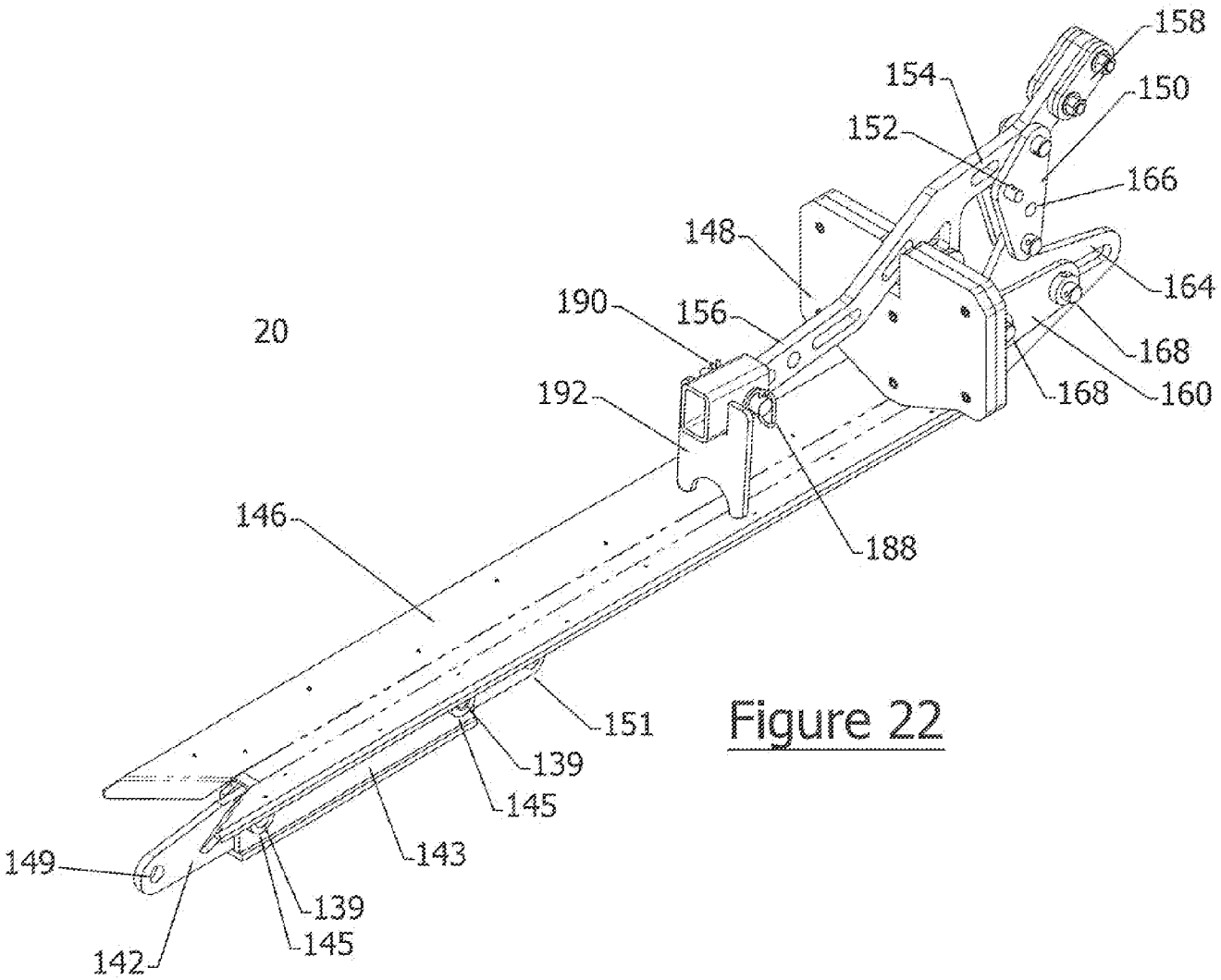
FIG. 22 is a perspective view depicting the skate of FIG. 21 with the grabber head arm in a lowered position.
Figure 24:
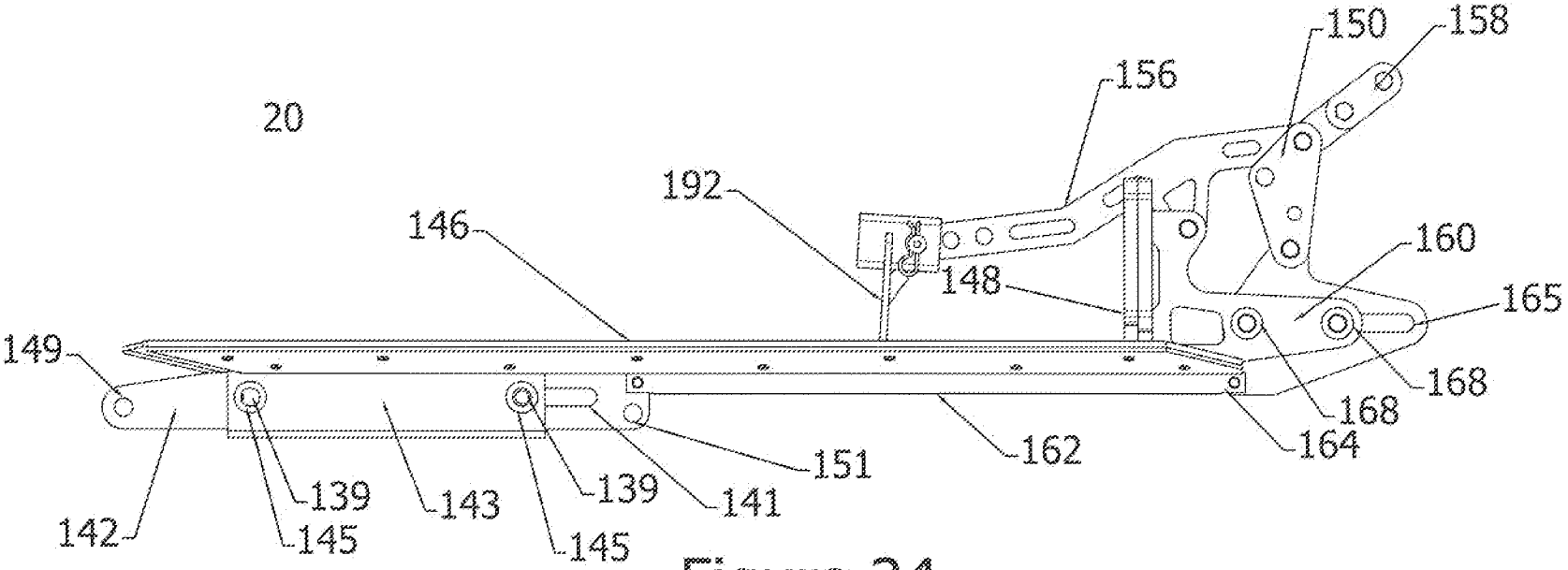
FIG. 24 is a side elevation view depicting the skate of FIG. 22.

When winch 132 is operated to move skate 20 to pull a pipe from V-door 12 into trough 28, rear cable 138 draws actuator plate 142 rearward relative to skate 20. This action draws actuator rod 162 rearward as well drawing slider plate 164 rearward as well. Due to the geometrical relationship between slider plate 164, locking plate 150, grabber arm 156 and linkage plate 160, the action of actuator plate 142 being pulled rearward by rear cable 138 causes grabber arm 156 to rotate and lower grabber head 144 towards from trough 146, as shown in FIGS. 22 and 24.

Figure 25:
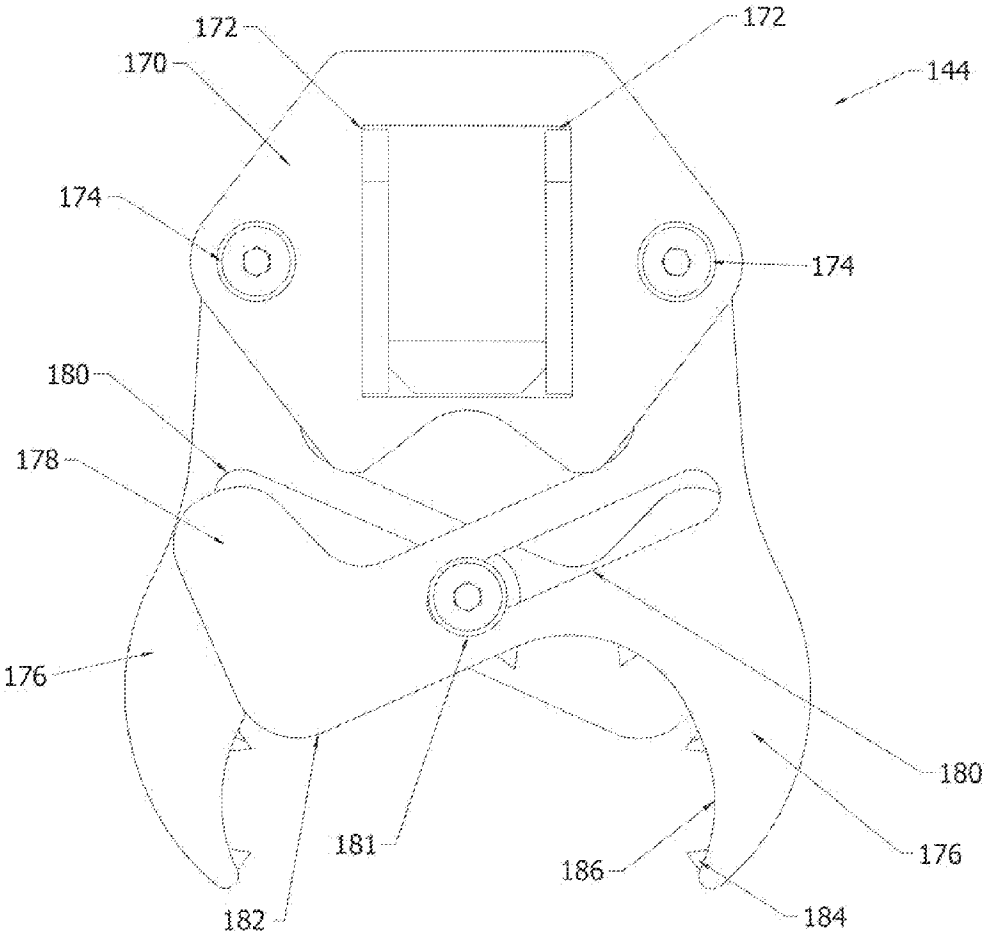
FIG. 25 is a rear elevation view depicting the grabber head of the skate of FIG. 21.
Figure 26:
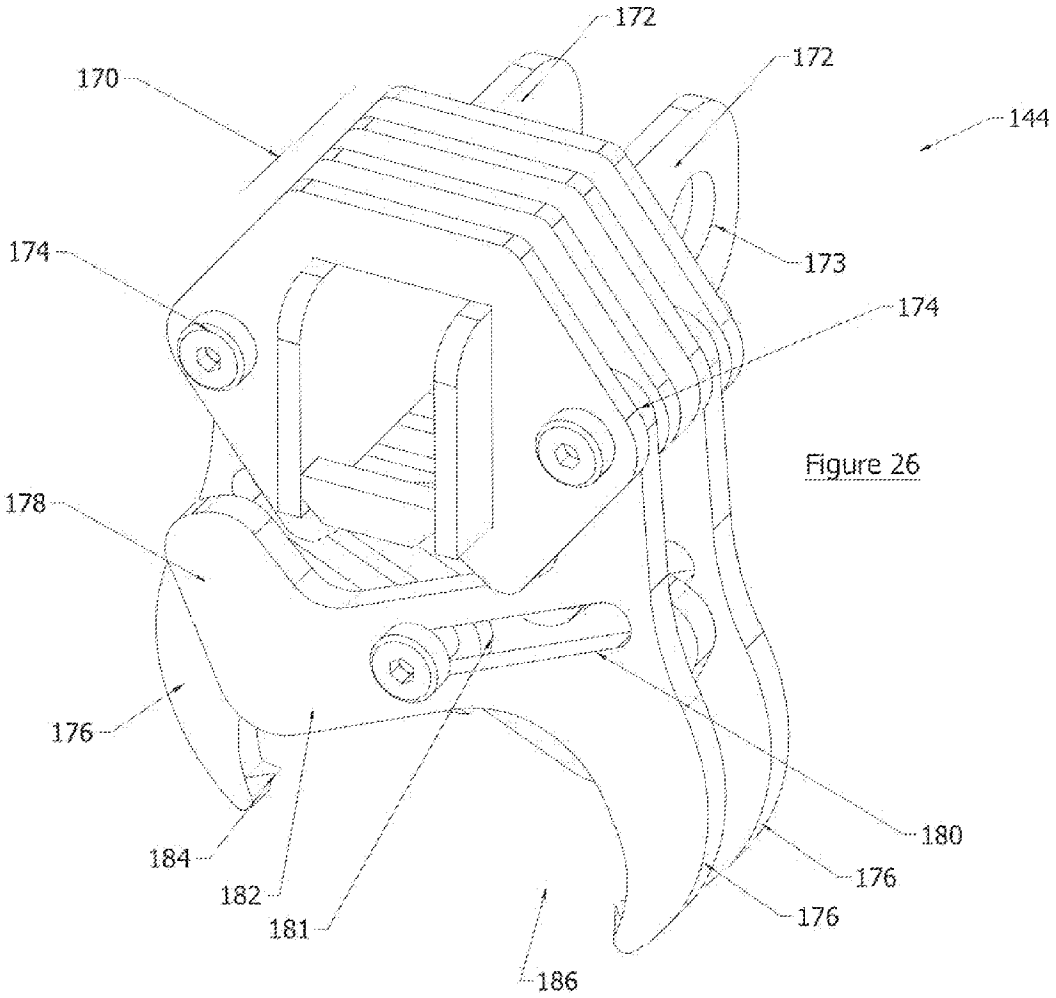
FIG. 26 is a rear perspective view depicting the grabber head of FIG. 25.
Figure 27:
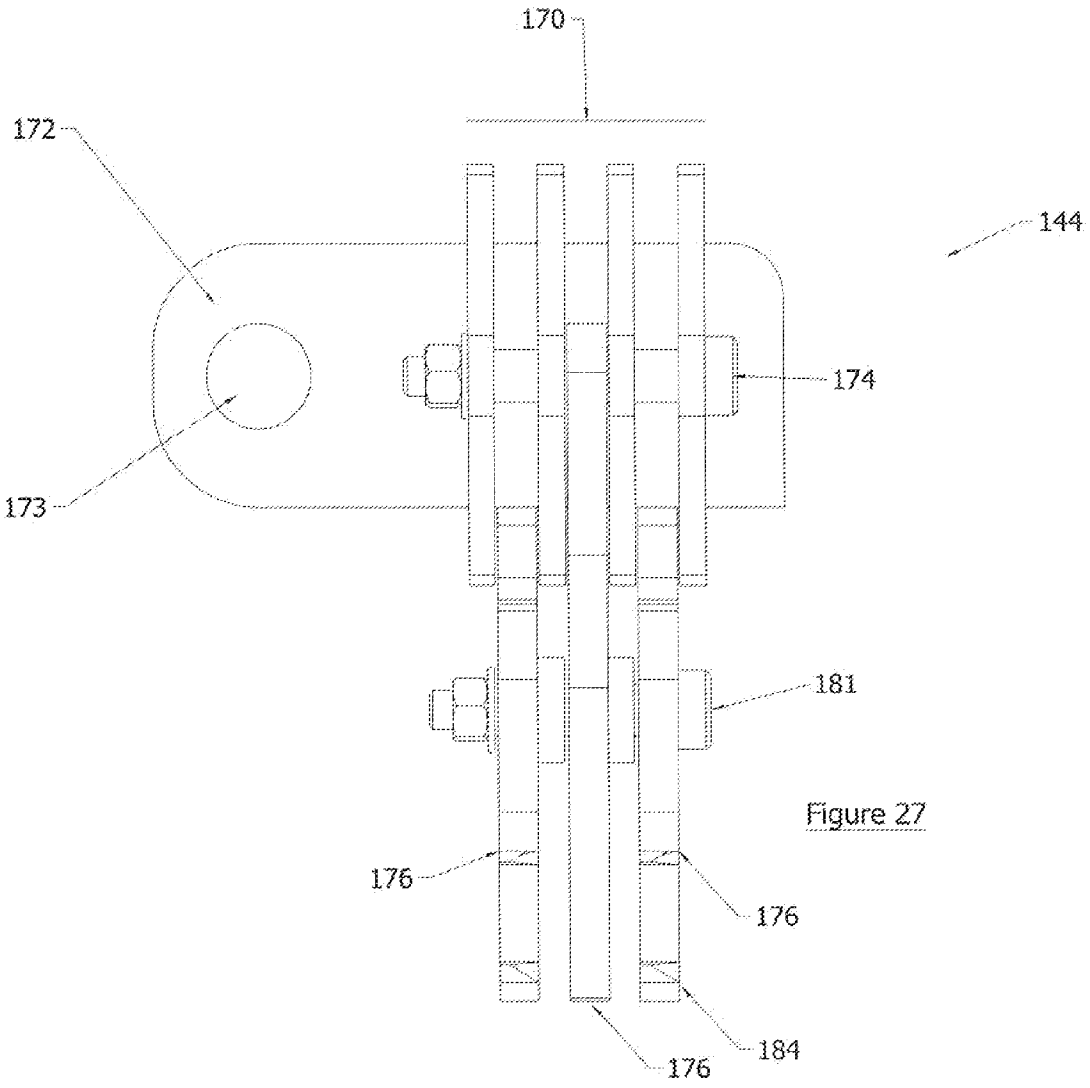
FIG. 27 is a side elevation view depicting the grabber head of FIG. 25.

Referring to FIGS. 25 to 27, an embodiment of grabber head 144 is shown. In some embodiments, grabber head 144 can comprise a plurality of plates 170 interleaved with grabber plates 176 pivotally attached to plates 170 with pivot bolts 174. Plates 170 can further comprise an opening extending therethrough to receive arm attachment plates 172, which can further comprise openings 173 for attaching to grabber arm 156. In further embodiments, each grabber plate 176 can comprise cam slot 180 through which slider bushing bolt 181 can extend therethrough. Each grabber plate 176 can further comprise jaw 186 having grabber teeth 184, and cam closing surface 182.

Figure 28:
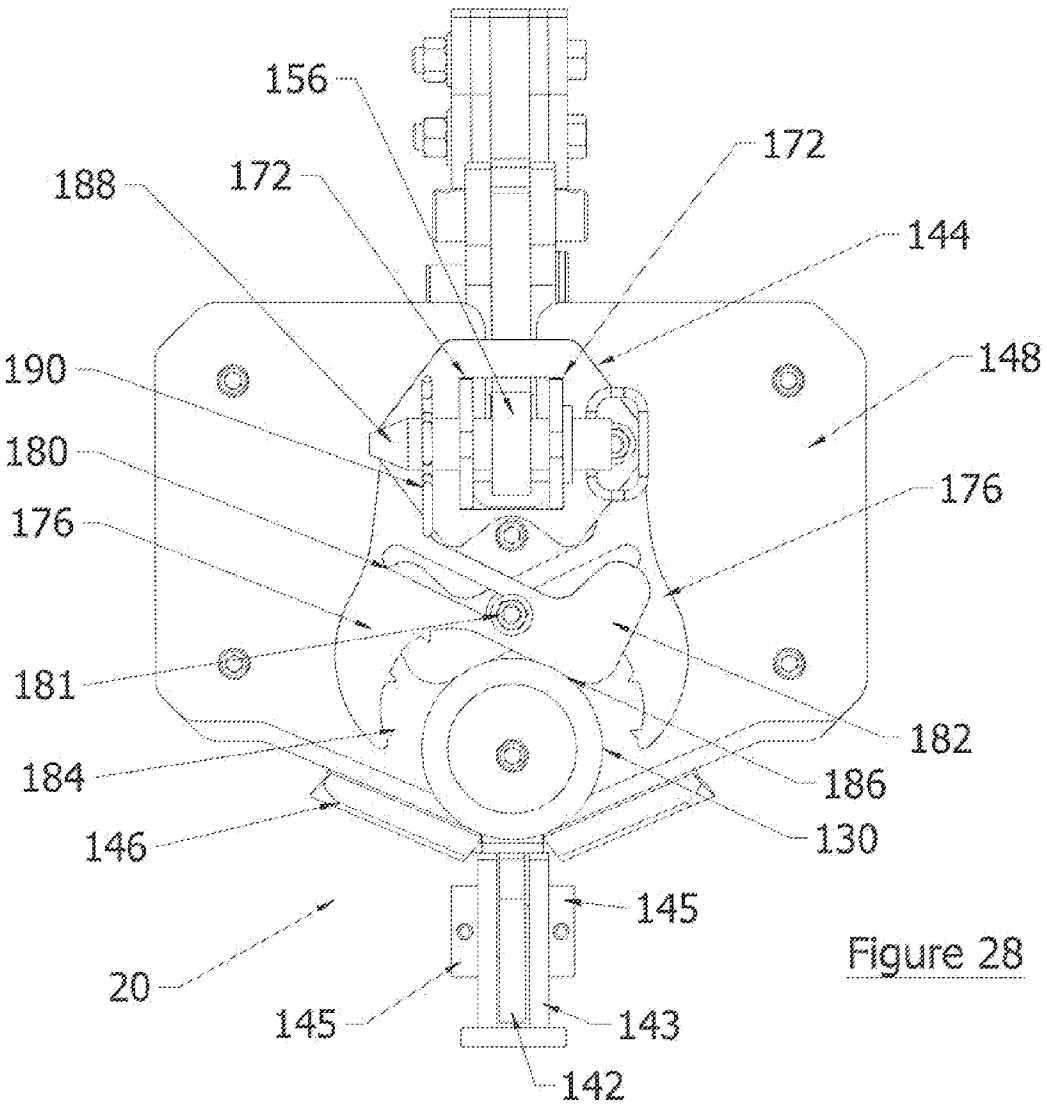
FIG. 28 is a front elevation view depicting a grabber head being lowered onto a pipe.
Figure 29:
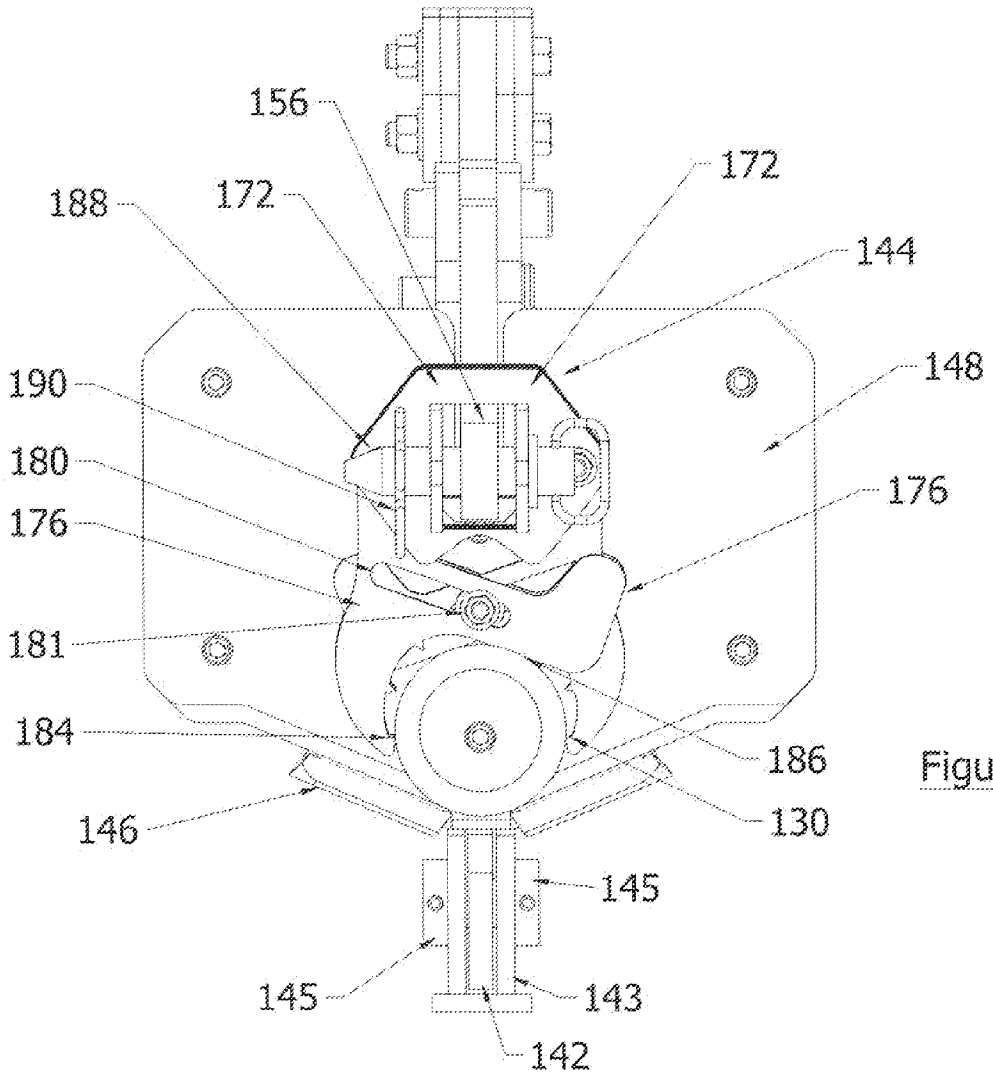
FIG. 29 is a front elevation view depicting the grabber head of FIG. 28 clamping onto a pipe.
Figure 30:
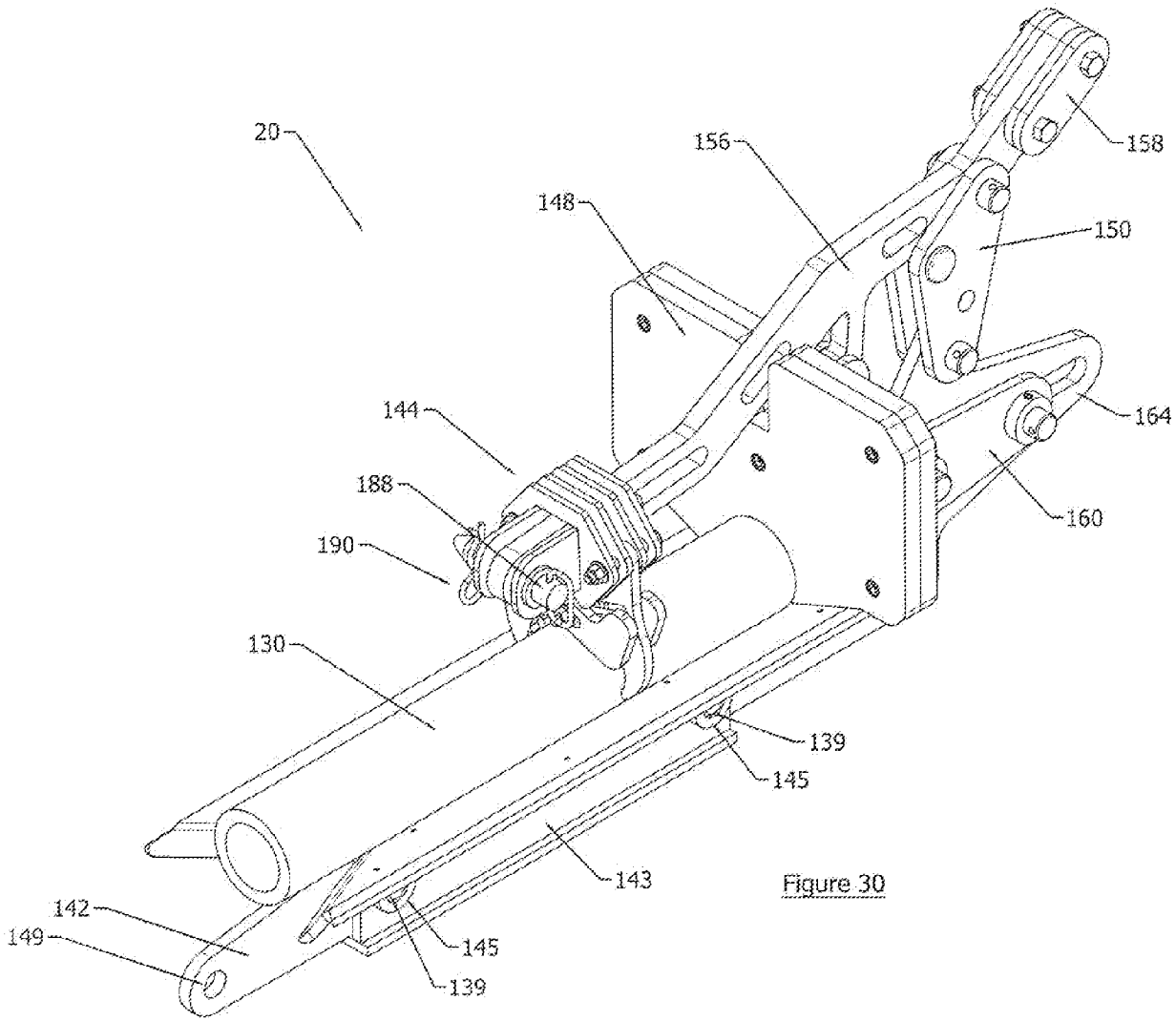
FIG. 30 is a perspective view depicting the grabber head of FIG. 28 clamping onto a pipe.

Referring to FIG. 28, grabber head 144 is shown attached to grabber arm 156 by pin 188 inserted through openings 173 and a corresponding opening on grabber arm 156. Pin 188 can be secured to grabber arm 156 by retainer pin 190. In this figure, grabber 144 is being lowered onto pipe 130 for the purpose of clamping onto pipe 130 to prevent it from rolling off skate 20, as could happen when pipe 130 is being retrieved from the work floor of a drilling or service rig, and skate 20 is being used to draw pipe 130 down V-door 12 onto trough 28 so that pipe 130 can be placed back on a pipe rack. As grabber head 144 is lowered down onto pipe 130, cam closing surface 186 of each grabber plate 176 contacts pipe 130. As grabber head 144 is lowered further, as caused by rear drive cable 138 pulling skate 20 away from V-door 12, each grabber plate 176 will pivot about pivot bolts 174 and slider bolt 181 and close in on pipe 130 wherein teeth 184 can bite into pipe 130 and hold it on skate 20 as skate 20 moves rearward away from V-door 12 (see FIGS. 29 and 30).

Figure 2:
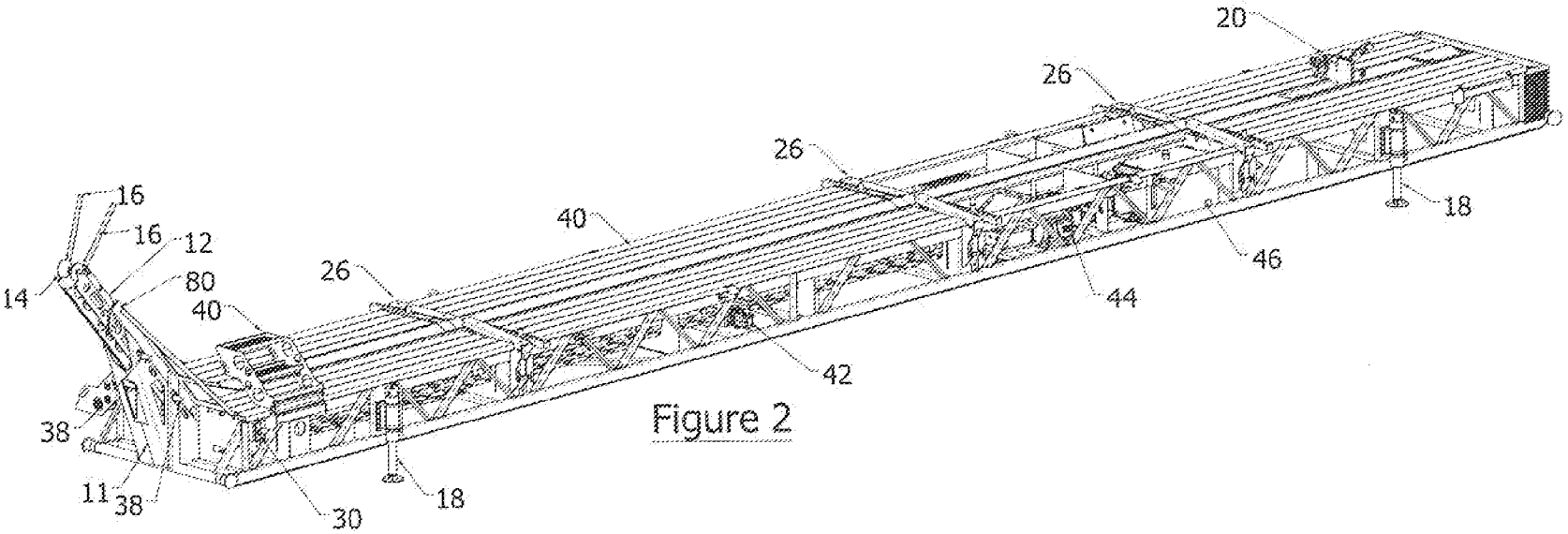
FIG. 2 is a perspective view depicting the catwalk of FIG. 1 without the pipe racks attached thereto.

In operation, catwalk 10 can comprise either or both of electrical and hydraulic power means to operate the functional features of catwalk 10. In some embodiments, catwalk 10 can comprise hydraulic power assembly 44 and hydraulic fluid tank 46 disposed in base assembly 11, as shown in FIG. 2. Hydraulic power assembly 44 can be driven by an electrical motor or by an internal combustion engine. As well known to those skilled in the art, hydraulic power can be used to operate indexers 26, kickers 27 and levelling legs 18. Hydraulic power can also be used to operate hydraulic motors that can be used as V-door drive motor 74 or as a motor to operate skate drive winch 132. In some embodiments, electrical motors can be used for drive motor 74 or skate drive winch 132. In these embodiments, catwalk 10 can comprise an electrical box to house electrical distribution panels configured to be connect electrical power, such 480 VAC or 600 VAC, 3-phase, 60 Hz alternating current electricity, as supplied from available commercial AC power or on-site AC power generators, to all of the electrically-powered components and devices used in the operational control of catwalk 10. In other embodiments, catwalk 10 can further comprise wireless interface electronics to operate some or all of the functional features of catwalk 10 using a wireless remote control device, as well known to those skilled in the art. In some embodiments, catwalk 10 can comprise one or more sets of controls disposed on catwalk 10. As an example, emergency shutdown ("ESD") and V-door controls 30 can be disposed on catwalk 10 near V-door 12 to provide means to operate V-door 12 (as shown in FIG. 1). Other embodiments can include start/stop and ESD controls 32 being disposed on catwalk 10 near skate stop 22 to provide means to start and stop the operation of catwalk 10. Further embodiments can include manual hydraulic valve controls disposed on catwalk 10 near hydraulic power assembly 44 to provide means to operate the hydraulically-operated devices disposed on catwalk 10.

For the purposes of the specification, the term "motor" can include either or both electrical motors and hydraulic motors. In addition, the term "linear actuator" can include hydraulic, pneumatic and/or electro-mechanical actuators. In addition, the term "hydraulic devices" can include hydraulic motors, linear actuators and like, whether or not controlled by valves. In addition, the term "valves" can include electrically controlled, hydraulically controlled, radio-controlled and/or manually controlled valves. It is obvious to those skilled in the art that valves can be used to control some or all of the functions of catwalk 10 from a central or single location disposed thereon. It is also obvious to those skilled in the art that wireless radio communication devices can be configured to control the electrics that control the valves that control some or all of the functions of catwalk 10 from a location remote from catwalk 10.

Although a few embodiments have been shown and described, it will be appreciated by those skilled in the art that various changes and modifications might be made without departing from the scope of the invention. The terms and expressions used in the preceding specification have been used herein as terms of description and not of limitation, and there is no intention in the use of such terms and expressions of excluding equivalents of the features shown and described or portions thereof, it being recognized that the invention is defined and limited only by the claims that follow.

We claim:

1. A pipe handling apparatus, comprising:

a) a substantially horizontal catwalk further comprising first and second ends and a top surface disposed therebetween, the catwalk further comprising a horizontal guide track disposed within the catwalk extending from the first end at least partially towards the second end;

b) a pipe trough disposed on the top surface between the first and second ends;

c) a V-door comprising a plurality of trough segments, the V-door slidably disposed in the catwalk, the V-door further configured to move along the horizontal guide track to extend from, and retract into, the first end of the catwalk;

d) a V-door guide track disposed at the first end of the catwalk and aligned with the horizontal guide track, the V-door guide configured to guide the V-door from a substantially horizontal position when disposed in the catwalk to an angled position relative to the catwalk when the V-door is extended from the catwalk along the horizontal guide track, the plurality of trough segments pivotally attached to each other to form a sequential series of segments wherein adjacent trough segments can pivot relative to one another when the V-door is guided through the V-door guide track; and e) a V-door drive mechanism disposed in the catwalk, the V-door drive mechanism configured to move the V-door along the horizontal and V-door guide tracks.

2. The apparatus as set forth in claim 1, further comprising at least one indexer/kicker unit disposed in the trough, the indexer/kicker unit configured for moving pipe into and out of the trough.

3. The apparatus as set forth in claim 2, further comprising a plurality of indexer/kicker units disposed in the trough in a spaced-apart configuration between the first and second ends.

4. The apparatus as set forth in claim 1, wherein the trough segments further comprise rollers configured to move along the horizontal guide track and the V-door guide track.

5. The apparatus as set forth in claim 1, wherein the trough segments are configured to lock together when the trough segments are extended beyond the V-door guide track.

6. The apparatus as set forth in claim 1, wherein each trough segment further comprises a V-door section top plate disposed on the top thereof, each top plate further comprising a leading edge and a trailing edge.

7. The apparatus as set forth in claim 6, wherein the trailing edge of each V-door section top plate is configured to move under the leading edge of the adjacent V-door section top plate when the V-door is extended from, and retracted into, the catwalk through the V-door guide track.

8. The apparatus as set forth in claim 1, further comprising:

a) a skate configured to move along the trough between the second and first ends along a skate guide track, the skate configured to move pipe along the trough towards the first end and up the V-door, and to retrieve pipe from the V-door and move the pipe along the trough towards the second end; and b) a skate drive mechanism disposed in the catwalk, the skate drive mechanism configured to move the skate along the skate guide track.

9. The apparatus as set forth in claim 8, wherein the skate further comprises a push plate for pushing pipe along the trough towards the first end and up the V-door.

10. The apparatus as set forth in claim 8, wherein the skate further comprises grabber head mechanism disposed thereon, the grabber head mechanism configured to grab pipe when retrieving pipe from the V-door and moving the pipe along the trough towards the second end.

11. The apparatus as set forth in claim 9, wherein the skate further comprises grabber head mechanism disposed thereon, the grabber head mechanism configured to grab pipe when retrieving pipe from the V-door and moving the pipe along the trough towards the second end.

12. A method for handling pipe, the method comprising the steps of:

a) providing a pipe handling apparatus, comprising:

i) a substantially horizontal catwalk further comprising first and second ends and a top surface disposed therebetween, the catwalk further comprising a horizontal guide track disposed within the catwalk extending from the first end at least partially towards the second end, ii) a pipe trough disposed on the top surface between the first and second ends, iii) a V-door comprising a plurality of trough segments, the V-door slidably disposed in the catwalk, the V-door further configured to move along the horizontal guide track to extend from, and retract into, the first end of the catwalk, iv) a V-door guide track disposed at the first end of the catwalk and aligned with the horizontal guide track, the V-door guide configured to guide the V-door from a substantially horizontal position when disposed in the catwalk to an angled position relative to the catwalk when the V-door is extended from the catwalk along the horizontal guide track, the plurality of trough segments pivotally attached to each other to form a sequential series of segments wherein adjacent trough segments can pivot relative to one another when the V-door is guided through the V-door guide track, and v) a V-door drive mechanism disposed in the catwalk, the V-door drive mechanism configured to move the V-door along the horizontal and V-door guide tracks;

b) extending the V-door from the catwalk and up the V-door guide track to a desired height wherein the V-door is adjacent to a work floor of a well drilling or service rig;

c) placing a section of pipe in the trough; and d) moving the section of pipe along the trough towards the first end and up the V-door wherein the section of pipe is presented to the work floor.

13. The method as set forth in claim 12, wherein the pipe handling apparatus further comprises at least one indexer/kicker unit disposed in the trough, the indexer/kicker unit configured for moving pipe into and out of the trough.

14. The method as set forth in claim 13, wherein the pipe handling apparatus further comprises a plurality of indexer/kicker units disposed in the trough in a spaced-apart configuration between the first and second ends.

15. The method as set forth in claim 12, wherein the trough segments further comprise rollers configured to move along the horizontal guide track and the V-door guide track.

16. The method as set forth in claim 12, wherein the trough segments are configured to lock together when the trough segments are extended beyond the V-door guide track.

17. The method as set forth in claim 12, wherein each trough segment further comprises a V-door section top plate disposed on the top thereof, each top plate further comprising a leading edge and a trailing edge.

18. The method as set forth in claim 17, wherein the trailing edge of each V-door section top plate is configured to move under the leading edge of the adjacent V-door section top plate when the V-door is extended from, and retracted into, the catwalk through the V-door guide track.

19. The method as set forth in claim 12, wherein the pipe handling apparatus further comprises:

a) a skate configured to move along the trough between the second and first ends along a skate guide track, the skate configured to move pipe along the trough towards the first end and up the V-door, and to retrieve pipe from the V-door and move the pipe along the trough towards the second end; and b) a skate drive mechanism disposed in the catwalk, the skate drive mechanism configured to move the skate along the skate guide track.

20. The method as set forth in claim 19, wherein the skate further comprises a push plate for pushing pipe along the trough towards the first end and up the V-door.

21. The method as set forth in claim 19, wherein the skate further comprises grabber head mechanism disposed thereon, the grabber head mechanism configured to grab pipe when retrieving pipe from the V-door and moving the pipe along the trough towards the second end.

22. The method as set forth in claim 20, wherein the skate further comprises grabber head mechanism disposed thereon, the grabber head mechanism configured to grab pipe when retrieving pipe from the V-door and moving the pipe along the trough towards the second end.

* * * * *